US010181374B2

(12) United States Patent
Katsuta et al.

(10) Patent No.: US 10,181,374 B2
(45) Date of Patent: Jan. 15, 2019

(54) ELECTRONIC COMPONENT

(71) Applicant: MURATA MANUFACTURING CO., LTD., Kyoto-fu (JP)

(72) Inventors: Mizuho Katsuta, Nagaokakyo (JP); Kosuke Ishida, Nagaokakyo (JP); Jun Karino, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 15/654,112

(22) Filed: Jul. 19, 2017

(65) Prior Publication Data

US 2018/0047491 A1 Feb. 15, 2018

(30) Foreign Application Priority Data

Aug. 10, 2016 (JP) ..... 2016-157740

(51) Int. Cl.

| | |
|---|---|
| ***H01F 17/00*** | (2006.01) |
| ***H01F 17/04*** | (2006.01) |
| ***H01F 27/28*** | (2006.01) |
| ***H01F 27/29*** | (2006.01) |
| ***H01F 27/40*** | (2006.01) |
| ***H01F 5/00*** | (2006.01) |

(52) U.S. Cl.

CPC ..... *H01F 17/0013* (2013.01); *H01F 17/0033* (2013.01); *H01F 17/04* (2013.01); *H01F 27/2871* (2013.01); *H01F 27/292* (2013.01); *H01F 27/40* (2013.01); *H01F 2017/0026* (2013.01); *H01F 2017/0093* (2013.01)

(58) Field of Classification Search

USPC ..... 336/200, 223, 232

See application file for complete search history.

(56) References Cited

FOREIGN PATENT DOCUMENTS

JP 2006-237080 A 9/2006

*Primary Examiner* — Ronald Hinson

(74) *Attorney, Agent, or Firm* — Studebaker & Brackett PC

(57) ABSTRACT

In an electronic component, a primary coil is electrically connected between a first outer electrode and a fourth outer electrode, a secondary coil is electrically connected between a second outer electrode and a fifth outer electrode, a tertiary coil is electrically connected between a third outer electrode and a sixth outer electrode, and a first inter-layer connection conductor, a second inter-layer connection conductor, and a third inter-layer connection conductor are electrically connected to the end portions at an inner side of a first coil conductor layer, a second coil conductor layer, and a third coil conductor layer, respectively. The first inter-layer connection conductor, the second inter-layer connection conductor, and the third inter-layer connection conductor are not positioned at one side of a second perpendicular direction, compared with a magnetic core, when viewed from a laminating direction.

13 Claims, 12 Drawing Sheets

ELECTRONIC COMPONENT

CROSS REFERENCE TO RELATED APPLICATIONS

This application claims benefit of priority to Japanese Patent Application 2016-157740 filed Aug. 10, 2016, the entire content of which is incorporated herein by reference.

TECHNICAL FIELD

The present disclosure relates to an electronic component including a common mode filter.

BACKGROUND

For example, a common mode choke coil described in Japanese Unexamined Patent Application Publication No. 2006-237080 is known as a disclosure related to a common mode filter in related art. FIG. 12 is an exploded perspective view of a common mode choke coil 510 described in Japanese Unexamined Patent Application Publication No. 2006-237080. A laminating direction of a multilayer body 512 is defined as the vertical direction in FIG. 12.

The common mode choke coil 510 includes the multilayer body 512, coil conductors 514, 516, and 518, extended conductors 520, 522, and 524, and through-hole conductors 530, 532, and 534. The coil conductors 514, 516, and 518 each form a spiral shape in which the coil conductor winds clockwise from an outer side to an inner side, when viewed from the upper side. The coil conductors 514, 516, and 518 overlap with each other. The coil conductor 516 is vertically sandwiched between the coil conductor 514 and the coil conductor 518. The through-hole conductor 530 connects one end portion of the extended conductor 520 to an end portion at the inner side of the coil conductor 514. The through-hole conductor 532 connects one end portion of the extended conductor 522 to an end portion at the inner side of the coil conductor 516. The through-hole conductor 534 connects one end portion of the extended conductor 524 to an end portion at the inner side of the coil conductor 518. The other end portion of each of the extended conductors 520, 522, and 524 is connected to an outer electrode (not illustrated). In the common mode choke coil 510 described above, a high-frequency signal is transmitted to the coil conductors 514 and 518 and ground potential is connected to the coil conductor 516.

SUMMARY

Increasing the inductance values of the coil conductors 514, 516, and 518 to increase common mode impedance is demanded in the common mode choke coil 510 described in Japanese Unexamined Patent Application Publication No. 2006-237080. In order to meet such a demand, a magnetic core may be provided in the multilayer body 512. In this case, the magnetic core desirably extends vertically in a wide range in an area surrounded by the coil conductors 514, 516, and 518.

However, the through-hole conductors 530, 532, and 534 are positioned near the center of the area surrounded by the coil conductors 514, 516, and 518 in the common mode choke coil 510. Accordingly, the area surrounded by the coil conductors 514, 516, and 518 is divided by the through-hole conductors 530, 532, and 534 near the center in the common mode choke coil 510 and it is difficult to ensure a large area where the magnetic core is capable of being arranged.

Accordingly, it is an object of the present disclosure to provide an electronic component capable of ensuring a large area where a magnetic core is capable of being arranged in an area surrounded by a first coil conductor layer, a second coil conductor layer, and a third coil conductor layer.

According to one embodiment of the present disclosure, an electronic component includes a main body including a multilayer body in which multiple insulating layers including multiple first insulating layers are laminated in a laminating direction; a primary coil including a spiral first coil conductor layer, a secondary coil including a spiral second coil conductor layer, and a tertiary coil including a spiral third coil conductor layer, the first coil conductor layer, the second coil conductor layer, and the third coil conductor layer being provided at different positions in the laminating direction in the multilayer body; a first outer electrode, a second outer electrode, and a third outer electrode that are provided on the main body and that are arranged in this order from a first side to a second side of a first perpendicular direction perpendicular to the laminating direction; a fourth outer electrode, a fifth outer electrode, and a sixth outer electrode that are provided on the main body, that are arranged in this order from the first side to the second side of the first perpendicular direction, and that are positioned at a first side of a second perpendicular direction perpendicular to the laminating direction and the first perpendicular direction, compared with the first outer electrode, the second outer electrode, and the third outer electrode; a magnetic core that passes through the multiple first insulating layers in the laminating direction so as to pass through the first coil conductor layer, the second coil conductor layer, and the third coil conductor layer in the laminating direction at a center of a certain area surrounded by the first coil conductor layer, the second coil conductor layer, and the third coil conductor layer, when viewed from the laminating direction, the magnetic core having a permeability higher than that of the multiple insulating layers; and a first inter-layer connection conductor, a second inter-layer connection conductor, and a third inter-layer connection conductor that pass through at least one of the multiple first insulating layers in the laminating direction in the certain area, when viewed from the laminating direction. The primary coil is electrically connected between the first outer electrode and the fourth outer electrode, the secondary coil is electrically connected between the second outer electrode and the fifth outer electrode, the tertiary coil is electrically connected between the third outer electrode and the sixth outer electrode, and the first inter-layer connection conductor, the second inter-layer connection conductor, and the third inter-layer connection conductor are electrically connected to an end portion at an inner side of the first coil conductor layer, an end portion at an inner side of the second coil conductor layer, and an end portion at an inner side of the third coil conductor layer, respectively. The first inter-layer connection conductor, the second inter-layer connection conductor, and the third inter-layer connection conductor are not positioned at the first side of the second perpendicular direction, compared with the magnetic core, when viewed from the laminating direction.

According to the present disclosure, it is possible to ensure a large area where a magnetic core is capable of being arranged in an area surrounded by a first coil conductor layer, a second coil conductor layer, and a third coil conductor layer.

Other features, elements, characteristics and advantages of the present disclosure will become more apparent from the following detailed description with reference to the attached drawings.

DETAILED DESCRIPTION

Electronic components according to embodiments of the present disclosure will be described.

(Configuration of Electronic Component)

Figure 1:
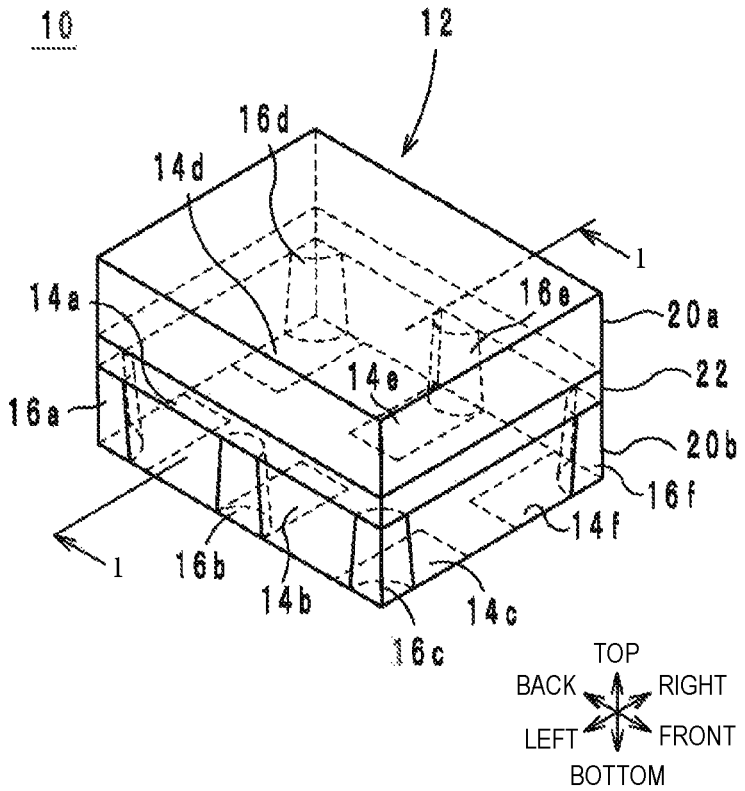
FIG. 1 is an external perspective view of an electronic component according to an embodiment.
Figure 2:
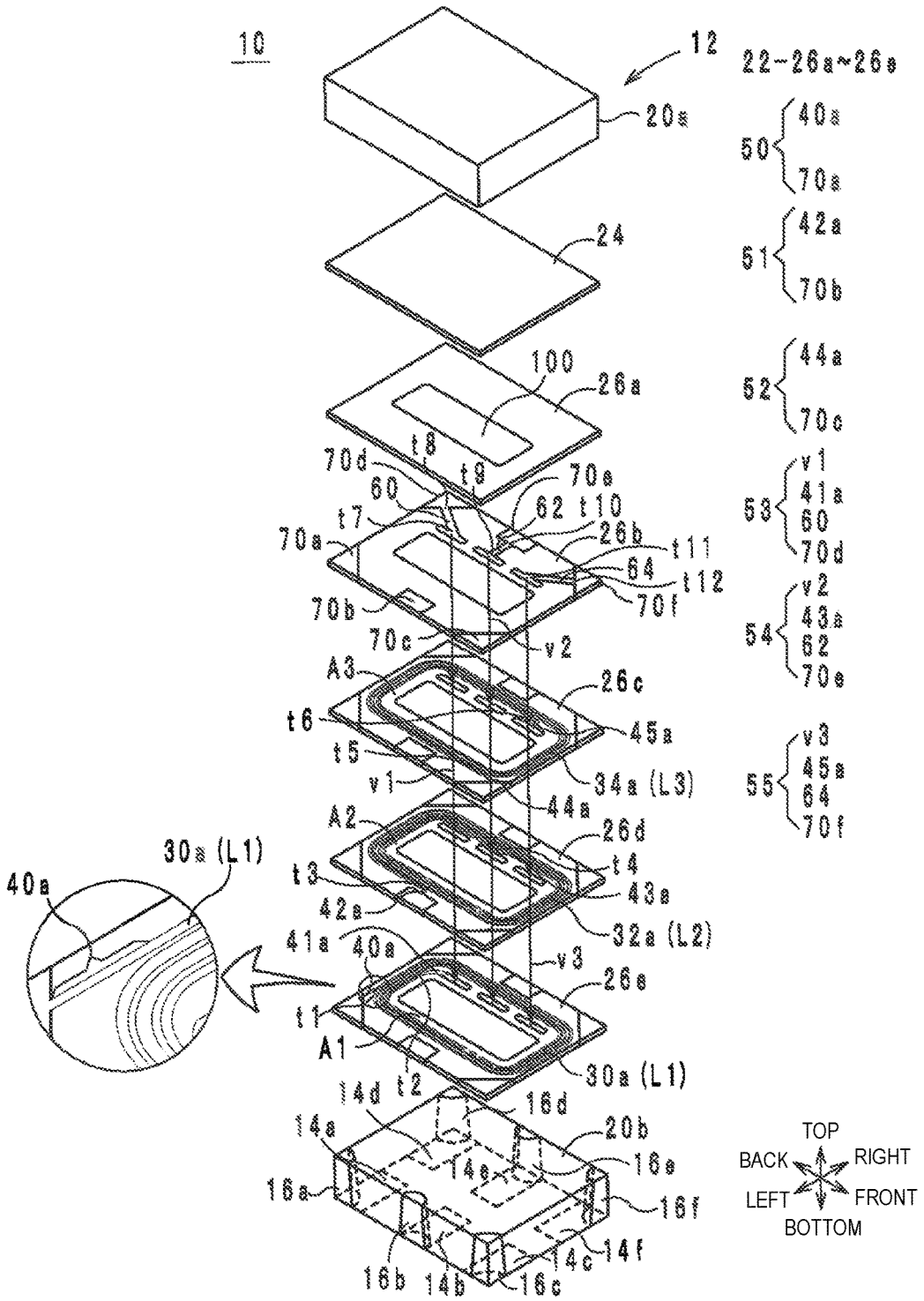
FIG. 2 is an exploded perspective view of the electronic component in FIG. 1.
Figure 3:
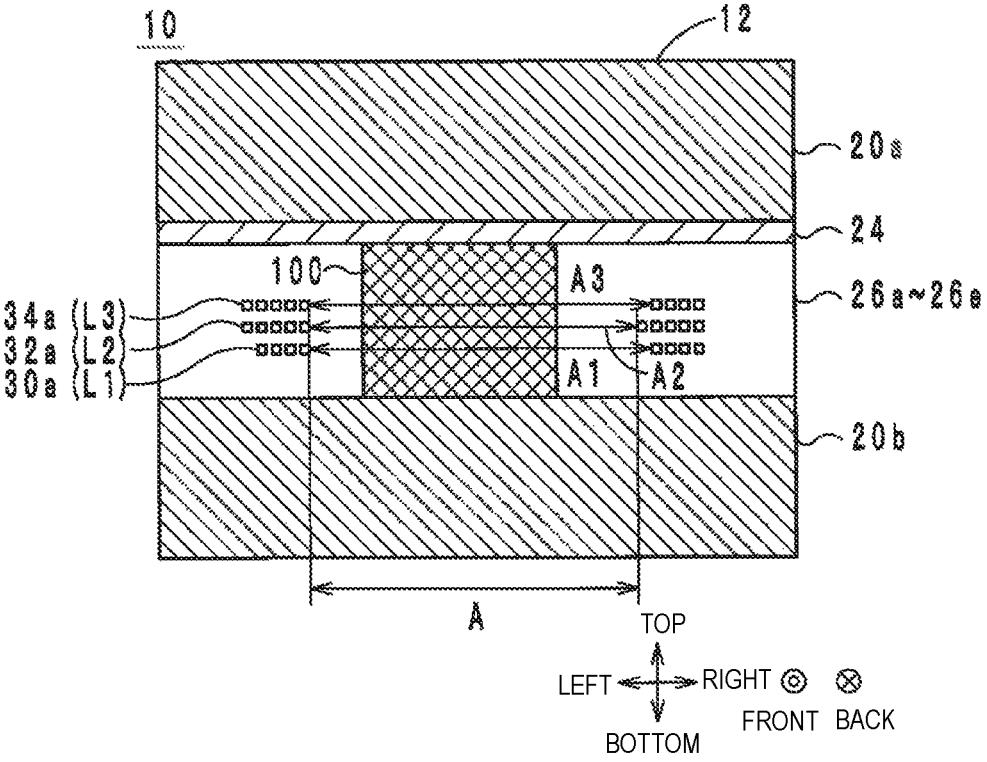
FIG. 3 is a cross-sectional view illustrating an exemplary structure of the electronic component in FIG. 1, taken along a 1-1 line.

An exemplary configuration of an electronic component 10 according to an embodiment of the present disclosure will herein be described with reference to the attached drawings. FIG. 1 is an external perspective view of the electronic component 10. FIG. 2 is an exploded perspective view of the electronic component 10 in FIG. 1. FIG. 3 is a cross-sectional view illustrating an exemplary structure of the electronic component 10 in FIG. 1, taken along a 1-1 line. A laminating direction of the electronic component 10 is defined as the vertical direction in the following description. In addition, the direction in which long sides extend, when viewed from the upper side, is defined as a front-and-back direction (an example of a first perpendicular direction). The direction in which short sides extend, when viewed from the upper side, is defined as a left-and-right direction (an example of a second perpendicular direction). The vertical direction, the front-and-back direction, and the left-and-right direction are perpendicular to each other. The laminating direction is a direction in which insulating layers described below are laminated on one another. The vertical direction, the front-and-back direction, and the left-and-right direction in use of the electronic component 10 may not coincide with the vertical direction, the front-and-back direction, and the left-and-right direction defined in, for example, FIG. 1.

The electronic component 10 includes a main body 12, outer electrodes 14*a* to 14*f*, connection portions 16*a* to 16*f*, extended portions 50 to 55, a magnetic core 100, a primary coil L1, a secondary coil L2, and a tertiary coil L3, as illustrated in FIG. 1 to FIG. 3.

The main body 12 forms a substantially rectangular parallelepiped shape, as illustrated in FIG. 1 and FIG. 2, and includes magnetic substrates 20*a* and 20*b*, a multilayer body 22, and a magnetic layer 24. The length of the main body 12 in the left-and-right direction is shorter than the length of the main body 12 in the front-and-back direction. The magnetic substrate 20*a*, the magnetic layer 24, the multilayer body 22, and the magnetic substrate 20*b* are laminated in this order from the upper side to the lower side. The main body 12 has a top face, a bottom face (an example of a face positioned at one side or the other side of the laminating direction), a right face (an example of a first face positioned at one side of the second perpendicular direction), a left face (an example of a second face positioned at the other side of the second perpendicular direction), a front face, and a back face. Each of the top face, the bottom face, the right face, the left face, the front face, and the back face of the main body 12 is a substantially planar face. The substantially planar face includes each slightly curved face resulting from barrel finishing of the electronic component 10.

Each of the magnetic substrates 20*a* and 20*b* is a plate-like member having a substantially rectangular shape, when viewed from the upper side. The upper main face of each of the magnetic substrates 20*a* and 20*b* is hereinafter referred to as the top face and the lower main face of each of the magnetic substrates 20*a* and 20*b* is hereinafter referred to as the bottom face. The magnetic substrate 20*b* has a structure in which four corners and central portions of the two long sides are notched, when viewed from the upper side. More specifically, a substantially fan-shaped notch having a central angle of about 90 degrees is provided at each of the four corners of the magnetic substrate 20*b*, when viewed from the upper side. A substantially semicircular notch is provided in each of the central portions of the two long sides of the magnetic substrate 20*b*, when viewed from the upper side. The six notches extend in the vertical direction on the side faces of the magnetic substrate 20*b* from the top face to the bottom face of the magnetic substrate 20*b*.

The magnetic substrates 20*a* and 20*b* are manufactured by cutting out sintered ferrite ceramics. The magnetic substrates 20*a* and 20*b* may be manufactured through thermosetting of magnetic paste containing magnetic powder, such as ferrite calcined powder or metal powder, and binder, such as resin, or application of the magnetic paste on a ceramic substrate made of alumina or the like or may be manufactured by laminating and firing green sheets made of a ferrite material.

The outer electrodes 14*a* to 14*f* are provided on the bottom face of the magnetic substrate 20*b* (that is, the bottom face of the main body 12) and each form a substantially rectangular shape. More specifically, the outer electrodes 14*a* to 14*c* have portions positioned near the left face of the main body 12, compared with coil conductor layers 30*a*, 32*a*, and 34*a* described below, when viewed from the upper side. In the present embodiment, the outer electrode

14*a* is provided at a back left corner of the bottom face of the magnetic substrate 20*b*. The outer electrode 14*b* is provided in a central portion of the left long side of the bottom face of the magnetic substrate 20*b*. The outer electrode 14*c* is provided at a front left corner of the bottom face of the magnetic substrate 20*b*. The outer electrodes 14*a* to 14*c* are arranged in this order from the back side to the front side (an example of from one side to the other side of the first perpendicular direction).

The outer electrodes 14*d* to 14*f* have portions positioned near the right face of the main body 12, compared with the coil conductor layers 30*a*, 32*a*, and 34*a* described below, when viewed from the upper side. The outer electrodes 14*d* to 14*f* are positioned on the right side (an example of one side of the second perpendicular direction) of the outer electrodes 14*a* to 14*c*. The outer electrode 14*d* is provided at a back right corner of the bottom face of the magnetic substrate 20*b*. The outer electrode 14*e* is provided in a central portion of the right long side of the bottom face of the magnetic substrate 20*b*. The outer electrode 14*f* is provided at a front right corner of the bottom face of the magnetic substrate 20*b*. The outer electrodes 14*d* to 14*f* are arranged in this order from the back side to the front side (an example of from one side to the other side of the first perpendicular direction). The outer electrodes 14*a* to 14*f* are each manufactured by forming an Au film, a Ni film, a Cu film, a Ti film, an Ag film, an Sn film, or the like or laminating any of the films using a sputtering method. The outer electrodes 14*a* to 14*f* may be each manufactured by printing and baking paste containing metal or may be each manufactured by forming, for example, an Ag film or a Cu film using a vapor deposition method or a plating method.

The connection portions 16*a* to 16*f* are provided on the six notches provided in or on the magnetic substrate 20*b*. Specifically, the connection portion 16*a* is provided on the notch positioned at the back left corner of the magnetic substrate 20*b* and is connected to the outer electrode 14*a* at its lower end portion. The connection portion 16*b* is provided on the notch positioned in the central portion of the left long side of the magnetic substrate 20*b* and is connected to the outer electrode 14*b* at its lower end portion. The connection portion 16*c* is provided on the notch positioned at the front left corner of the magnetic substrate 20*b* and is connected to the outer electrode 14*c* at its lower end portion. The connection portion 16*d* is provided on the notch positioned at the back right corner of the magnetic substrate 20*b* and is connected to the outer electrode 14*d* at its lower end portion. The connection portion 16*e* is provided on the notch positioned in the central portion of the right long side of the magnetic substrate 20*b* and is connected to the outer electrode 14*e* at its lower end portion. The connection portion 16*f* is provided on the notch positioned at the front right side of the magnetic substrate 20*b* and is connected to the outer electrode 14*f* at its lower end portion. The connection portions 16*a* to 16*f* are each manufactured using substantially the same material and substantially the same method as those of the outer electrodes 14*a* to 14*f*.

The multilayer body 22 has a structure in which insulating layer 26*a* to 26*e* (an example of multiple insulating layers) are laminated so as to be arranged in this order from the upper side to the lower side. The multilayer body 22 forms a substantially rectangular shape, when viewed from the upper side, and has substantially the same shape as that of the top face of the magnetic substrate 20*b*. However, the four corners and the central portions of the two long sides of each of the insulating layers 26*b* to 26*e* are notched, when viewed from the upper side.

The insulating layers 26*a* to 26*e* are made of polyimide. The insulating layers 26*a* to 26*e* may be made of insulating resin, such as benzocyclobutene, or may be made of an insulating inorganic material, such as glass ceramics. The upper main face of each of the insulating layers 26*a* to 26*e* is hereinafter referred to as a top face and the lower main face of each of the insulating layers 26*a* to 26*e* is hereinafter referred to as a bottom face.

The magnetic layer 24 is provided between the multilayer body 22 and the magnetic substrate 20*a*. The magnetic layer 24 flattens the top face of the multilayer body 22 and joins the multilayer body 22 to the magnetic substrate 20*a*. The magnetic layer 24 is made of, for example, the magnetic paste described above.

The primary coil L1 is provided in the multilayer body 22 and has an end portion t1 (an example of an end portion at the other side) and an end portion t2 (an example of an end portion at one side). The end portion t1 is closer to the outer electrode 14*a* in the primary coil L1. The end portion t2 is closer to the outer electrode 14*d* in the primary coil L1. The primary coil L1 is electrically connected between the outer electrode 14*a* and the outer electrode 14*d*. The primary coil L1 includes the coil conductor layer 30*a* (an example of a first coil conductor layer and a primary coil conductor layer).

The coil conductor layer 30*a* is provided on the top face of the insulating layer 26*e* and forms a spiral shape in which the coil conductor winds clockwise from an outer side to an inner side, when viewed from the upper side. In the present embodiment, the coil conductor layer 30*a* has a length of about 4.25 turns. The center of the coil conductor layer 30*a* substantially coincides with the center (the intersection of diagonal lines) of the electronic component 10, when viewed from the upper side. The end portion at the outer side of the coil conductor layer 30*a* is the end portion t1 of the primary coil L1. The end portion at the inner side of the coil conductor layer 30*a* is the end portion t2 of the primary coil L1. An area surrounded by the coil conductor layer 30*a* is referred to as an area A1. The area A1 forms a substantially rectangular shape having long sides extending in the front-and-back direction and short sides extending in the left-and-right direction, when viewed from the upper side. The spiral shape means a two-dimensional spiral.

The extended portion 50 electrically connects the end portion t1 of the primary coil L1 (the end portion at the outer side of the coil conductor layer 30*a*) to the outer electrode 14*a* (an example of a fourth outer electrode). The extended portion 50 includes an extended conductor layer 40*a* and a connection conductor 70*a*. The connection conductor 70*a* is a substantially triangular prism conductor provided at the back left corners of the insulating layers 26*b* to 26*e*. The connection conductor 70*a* is illustrated with being divided into five portions in FIG. 2 for convenience. Each of the connection conductors 70*b* to 70*f* described below is also illustrated with being divided into five portions, as in the connection conductor 70*a*. The connection conductor 70*a* extends in the vertical direction from the top face of the insulating layer 26*b* to the bottom face of the insulating layer 26*e* and is connected to the connection portion 16*a* at its lower end portion.

The extended conductor layer 40*a* is provided on the top face of the insulating layer 26*e*. The extended conductor layer 40*a* is connected to the end portion at the outer side of the coil conductor layer 30*a* and is connected to the connection conductor 70*a*. The extended conductor layer 40*a* does not form a spiral shape, when viewed from the upper side, and extends leftward from the end portion at the outer side of the coil conductor layer 30*a*. The boundary between the coil conductor layer 30*a* and the extended conductor layer 40*a* is at a position where the extended conductor layer 40*a* steps away from the spiral path formed by the coil conductor layer 30*a*, as illustrated in an enlarged view in FIG. 2. Accordingly, the end portion t1 of the primary coil L1 (the end portion at the outer side of the coil conductor layer 30*a*) is connected to the outer electrode 14*a* with the extended portion 50 (the extended conductor layer 40*a* and the connection conductor 70*a*) and the connection portion 16*a* interposed therebetween.

The extended portion 53 (an example of a first extended portion) connects the end portion t2 of the primary coil L1 (the end portion at the inner side of the coil conductor layer 30*a*) to the outer electrode 14*d* (an example of a first outer electrode). The extended portion 53 includes an inter-layer connection conductor v1, extended conductor layers 41*a* and 60, and a connection conductor 70*d*. The connection conductor 70*d* is a substantially triangular prism conductor provided at the back right corners of the insulating layers 26*b* to 26*e*. The connection conductor 70*d* extends in the vertical direction from the top face of the insulating layer 26*b* to the bottom face of the insulating layer 26*e* and is connected to the connection portion 16*d* at its lower end portion.

The inter-layer connection conductor v1 (an example of a first inter-layer connection conductor) passes through the insulating layers 26*b* to 26*d* in the vertical direction in the area A1, when viewed from the upper side, and forms a substantially linear shape extending in the front-and-back direction. The inter-layer connection conductor v1 is also provided on the top face of the insulating layer 26*e*. The inter-layer connection conductor v1 is positioned near the rear end of the right long side of the area A1, when viewed from the upper side.

The extended conductor layer 41*a* is provided on the top face of the insulating layer 26*e*. The extended conductor layer 41*a* is connected to the end portion at the inner side of the coil conductor layer 30*a* and is connected to the inter-layer connection conductor v1. Accordingly, the inter-layer connection conductor v1 is electrically connected to the end portion at the inner side of the coil conductor layer 30*a*. The extended conductor layer 41*a* does not form a spiral shape, when viewed from the upper side, and extends toward the right front from the end portion at the inner side of the coil conductor layer 30*a*. The boundary between the coil conductor layer 30*a* and the extended conductor layer 41*a* is at a position where the extended conductor layer 41*a* steps away from the spiral path formed by the coil conductor layer 30*a*.

The extended conductor layer 60 (an example of a first extended conductor layer) is provided on the top face of the insulating layer 26*b*. The extended conductor layer 60 is connected to the inter-layer connection conductor v1 and is also connected to the connection conductor 70*d*. More specifically, the extended conductor layer 60 has an end portion t7 (an example of the end portion at one side) and an end portion t8 (an example of the end portion at the other side). The end portion t7 of the extended conductor layer 60 is connected to the inter-layer connection conductor v1. The end portion t8 of the extended conductor layer 60 is positioned near the right face of the main body 12, compared with the coil conductor layer 30*a*, when viewed from the upper side, and overlaps with the outer electrode 14*d*. In addition, the end portion t8 of the extended conductor layer 60 is connected to the connection conductor 70*d*. Accordingly, the end portion t2 of the primary coil L1 (the end portion at the inner side of the coil conductor layer 30*a*) is connected to the outer electrode 14*d* with the extended portion 53 (the inter-layer connection conductor v1, the extended conductor layers 41*a* and 60, and the connection conductor 70*d*) and the connection portion 16*d* interposed therebetween.

The secondary coil L2 is provided in the multilayer body 22 and has an end portion t3 (an example of the end portion at the other side) and an end portion t4 (an example of the end portion at one side). The end portion t3 is closer to the outer electrode 14*b* in the secondary coil L2. The end portion t4 is closer to the outer electrode 14*e* in the secondary coil L2. The secondary coil L2 is electrically connected between the outer electrode 14*b* and the outer electrode 14*e*. The secondary coil L2 includes the coil conductor layer 32*a* (an example of a second coil conductor layer and a secondary coil conductor layer).

The coil conductor layer 32*a* is provided on the top face of the insulating layer 26*d* and forms a spiral shape in which the coil conductor winds clockwise from the outer side to the inner side, when viewed from the upper side. In the present embodiment, the coil conductor layer 32*a* has a length of about 4.5 turns. The center of the coil conductor layer 32*a* substantially coincides with the center (the intersection of diagonal lines) of the electronic component 10, when viewed from the upper side. The end portion at the outer side of the coil conductor layer 32*a* is the end portion t3 of the secondary coil L2. The end portion at the inner side of the coil conductor layer 32*a* is the end portion t4 of the secondary coil L2. An area surrounded by the coil conductor layer 32*a* is referred to as an area A2. The area A2 forms a substantially rectangular shape having long sides extending in the front-and-back direction and short sides extending in the left-and-right direction, when viewed from the upper side.

The coil conductor layer 32*a* mostly overlaps with the coil conductor layer 30*a*, when viewed from the upper side, as illustrated in FIG. 2 and FIG. 3. Accordingly, the area A1 surrounded by the coil conductor layer 30*a* (an inner magnetic path of the primary coil L1) overlaps with the area A2 surrounded by the coil conductor layer 32*a* (an inner magnetic path of the secondary coil L2), when viewed from the upper side. Consequently, the coil conductor layer 30*a* (the primary coil L1) is magnetically coupled to the coil conductor layer 32*a* (the secondary coil L2). However, the positions of both ends of the coil conductor layer 30*a* are shifted from the positions of both ends of the coil conductor layer 32*a* so that the extended portions 50 and 53 do not interfere with extended portions 51 and 54 described below. Specifically, the end portion at the outer side of the coil conductor layer 32*a* is positioned at the upstream side of the end portion at the outer side of the coil conductor layer 30*a* in a clockwise direction. The end portion at the inner side of the coil conductor layer 32*a* is positioned at the downstream side of the end portion at the inner side of the coil conductor layer 30*a* in the clockwise direction. Accordingly, the length of the coil conductor layer 30*a* is slightly longer than the length of the coil conductor layer 32*a*. Since it is sufficient for the coil conductor layer 30*a* and the coil conductor layer 32*a* to be magnetically coupled to each other, the coil conductor layer 30*a* may not mostly overlap with the coil conductor layer 32*a*. The coil conductor layer 30*a* and the coil conductor layer 32*a* may be slightly shifted from each other in the front-and-back direction or in the left-and-right direction. In other words, it is sufficient for the coil conductor layer 32*a* to be provided at the upper side of the coil conductor layer 30*a*.

The extended portion 51 electrically connects the end portion t3 of the secondary coil L2 (the end portion at the outer side of the coil conductor layer 32*a*) to the outer electrode 14*b* (an example of a fifth outer electrode). The extended portion 51 includes an extended conductor layer 42*a* and a connection conductor 70*b*. The connection conductor 70*b* is a substantially rectangular prism conductor provided in the central portions of the left long sides of the insulating layers 26*b* to 26*e*. The connection conductor 70*b* extends in the vertical direction from the top face of the insulating layer 26*b* to the bottom face of the insulating layer 26*e* and is connected to the connection portion 16*b* at its lower end portion.

The extended conductor layer 42*a* is provided on the top face of the insulating layer 26*d*. The extended conductor layer 42*a* is connected to the end portion at the outer side of the coil conductor layer 32*a* and is connected to the connection conductor 70*b*. The extended conductor layer 42*a* does not form a spiral shape, when viewed from the upper side, and extends leftward from the end portion at the outer side of the coil conductor layer 32*a*. Accordingly, the end portion t3 of the secondary coil L2 (the end portion at the outer side of the coil conductor layer 32*a*) is connected to the outer electrode 14*b* with the extended portion 51 (the extended conductor layer 42*a* and the connection conductor 70*b*) and the connection portion 16*b* interposed therebetween.

The extended portion 54 (an example of a second extended portion) connects the end portion t4 of the secondary coil L2 (the end portion at the inner side of the coil conductor layer 32*a*) to the outer electrode 14*e* (an example of a second outer electrode). The extended portion 54 includes an inter-layer connection conductor v2, extended conductor layers 43*a* and 62, and a connection conductor 70*e*. The connection conductor 70*e* is a substantially rectangular prism conductor provided in the central portions of the right long sides of the insulating layers 26*b* to 26*e*. The connection conductor 70*e* extends in the vertical direction from the top face of the insulating layer 26*b* to the bottom face of the insulating layer 26*e* and is connected to the connection portion 16*e* at its lower end portion.

The inter-layer connection conductor v2 (an example of a second inter-layer connection conductor) passes through the insulating layers 26*b* to 26*d* in the vertical direction in the area A2, when viewed from the upper side, and forms a substantially linear shape extending in the front-and-back direction. The inter-layer connection conductor v2 is also provided on the top face of the insulating layer 26*e*. The inter-layer connection conductor v2 is positioned near the central portion of the right long side of the area A2, when viewed from the upper side.

The extended conductor layer 43*a* is provided on the top face of the insulating layer 26*d*. The extended conductor layer 43*a* is connected to the end portion at the inner side of the coil conductor layer 32*a* and is connected to the inter-layer connection conductor v2. Accordingly, the inter-layer connection conductor v2 is electrically connected to the end portion at the inner side of the coil conductor layer 32*a*. The extended conductor layer 43*a* does not form a spiral shape, when viewed from the upper side, and extends leftward from the end portion at the inner side of the coil conductor layer 32*a*. The boundary between the coil conductor layer 32*a* and the extended conductor layer 43*a* is at a position where the extended conductor layer 43*a* steps away from the spiral path formed by the coil conductor layer 32*a*.

The extended conductor layer 62 (an example of a second extended conductor layer) is provided on the top face of the insulating layer 26*b*. The extended conductor layer 62 is connected to the inter-layer connection conductor v2 and is also connected to the connection conductor 70*e*. More specifically, the extended conductor layer 62 has an end portion t9 and an end portion t10. The end portion t9 of the extended conductor layer 62 is connected to the inter-layer connection conductor v2. The end portion t10 of the extended conductor layer 62 is positioned near the right face of the main body 12, compared with the coil conductor layer 32*a*, when viewed from the upper side, and overlaps with the outer electrode 14*e*. In addition, the end portion t10 of the extended conductor layer 62 is connected to the connection conductor 70*e*. Accordingly, the end portion t4 of the secondary coil L2 (the end portion at the inner side of the coil conductor layer 32*a*) is connected to the outer electrode 14*e* with the extended portion 54 (the inter-layer connection conductor v2, the extended conductor layers 43*a* and 62, and the connection conductor 70*e*) and the connection portion 16*e* interposed therebetween.

The tertiary coil L3 is provided in the multilayer body 22 and has an end portion t5 (an example of the end portion at the other side) and an end portion t6 (an example of the end portion at one side). The end portion t5 is closer to the outer electrode 14*c* in the tertiary coil L3. The end portion t6 is closer to the outer electrode 14*f* in the tertiary coil L3. The tertiary coil L3 is electrically connected between the outer electrode 14*c* and the outer electrode 14*f*. The tertiary coil L3 includes the coil conductor layer 34*a* (an example of a third coil conductor layer and a tertiary coil conductor layer).

The coil conductor layer 34*a* is provided on the top face of the insulating layer 26*c* and forms a spiral shape in which the coil conductor winds clockwise from the outer side to the inner side, when viewed from the upper side. In the present embodiment, the coil conductor layer 34*a* has a length of about 3.75 turns. The center of the coil conductor layer 34*a* substantially coincides with the center (the intersection of diagonal lines) of the electronic component 10, when viewed from the upper side. The end portion at the outer side of the coil conductor layer 34*a* is the end portion t5 of the tertiary coil L3. The end portion at the inner side of the coil conductor layer 34*a* is the end portion t6 of the tertiary coil L3. An area surrounded by the coil conductor layer 34*a* is referred to as an area A3. The area A3 forms a substantially rectangular shape having long sides extending in the front-and-back direction and short sides extending in the left-and-right direction, when viewed from the upper side.

The coil conductor layers 30*a*, 32*a*, and 34*a* are provided at vertically different positions in the multilayer body 22. The coil conductor layer 34*a* mostly overlaps with the coil conductor layers 30*a* and 32*a*, when viewed from the upper side, as illustrated in FIG. 2 and FIG. 3. Accordingly, the area A1 surrounded by the coil conductor layer 30*a* (the inner magnetic path of the primary coil L1), the area A2 surrounded by the coil conductor layer 32*a* (the inner magnetic path of the secondary coil L2), and the area A3 surrounded by the coil conductor layer 34*a* (an inner magnetic path of the tertiary coil L3) overlap with each other, when viewed from the upper side. Consequently, the coil conductor layer 30*a* (the primary coil L1), the coil conductor layer 32*a* (the secondary coil L2), and the coil conductor layer 34*a* (the tertiary coil L3) are magnetically coupled to each other. However, the positions of both ends of the coil conductor layer 30*a*, the positions of both ends of the coil conductor layer 32*a*, and the positions of both ends of the coil conductor layer 34*a* are shifted from each other so that the extended portions 50 and 53, the extended portions 51 and 54, and extended portions 52 and 55 do not interfere with each other. Specifically, the end portion at the outer side of the coil conductor layer 34*a* is positioned at the upstream side of the end portions at the outer side of the coil conductor layers 30*a* and 32*a* in the clockwise direction. The end portion at the inner side of the coil conductor layer 34*a* is positioned at the downstream side of the end portions at the inner side of the coil conductor layers 30*a* and 32*a* in the clockwise direction. However, the number of turns of the coil conductor layer 34*a* is smaller than the numbers of turns of the coil conductor layers 30*a* and 32*a* by one. Accordingly, the length of the coil conductor layer 34*a* is slightly shorter than the length of the coil conductor layer 32*a* and the length of the coil conductor layer 30*a*. Since it is sufficient for the coil conductor layer 30*a*, the coil conductor layer 32*a*, and the coil conductor layer 34*a* to be magnetically coupled to each other, the coil conductor layer 30*a*, the coil conductor layer 32*a*, and the coil conductor layer 34*a* may not mostly overlap with each other. The coil conductor layer 30*a*, the coil conductor layer 32*a*, and the coil conductor layer 34*a* may be slightly shifted from each other in the front-and-back direction or in the left-and-right direction. In other words, it is sufficient for the coil conductor layer 34*a* to be provided at the upper side of the coil conductor layers 30*a* and 32*a*.

The extended portion 52 electrically connects the end portion t5 of the tertiary coil L3 (the end portion at the outer side of the coil conductor layer 34*a*) to the outer electrode 14*c* (an example of a sixth outer electrode). The extended portion 52 includes an extended conductor layer 44*a* and a connection conductor 70*c*. The connection conductor 70*c* is a substantially triangular prism conductor provided at the front left corners of the insulating layers 26*b* to 26*e*. The connection conductor 70*c* extends in the vertical direction from the top face of the insulating layer 26*b* to the bottom face of the insulating layer 26*e* and is connected to the connection portion 16*c* at its lower end portion.

The extended conductor layer 44*a* is provided on the top face of the insulating layer 26*c*. The extended conductor layer 44*a* is connected to the end portion at the outer side of the coil conductor layer 34*a* and is connected to the connection conductor 70*c*. The extended conductor layer 44*a* does not form a spiral shape, when viewed from the upper side, and extends forward from the end portion at the outer side of the coil conductor layer 34*a*. Accordingly, the end portion t5 of the tertiary coil L3 (the end portion at the outer side of the coil conductor layer 34*a*) is connected to the outer electrode 14*c* with the extended portion 52 (the extended conductor layer 44*a* and the connection conductor 70*c*) and the connection portion 16*c* interposed therebetween.

The extended portion 55 (an example of a third extended portion) connects the end portion t6 of the tertiary coil L3 (the end portion at the inner side of the coil conductor layer 34*a*) to the outer electrode 14*f* (an example of a third outer electrode). The extended portion 55 includes an inter-layer connection conductor v3, extended conductor layers 45*a* and 64, and a connection conductor 70*f*. The connection conductor 70*f* is a substantially triangular prism conductor provided at the front right corners of the insulating layers 26*b* to 26*e*. The connection conductor 70*f* extends in the vertical direction from the top face of the insulating layer 26*b* to the bottom face of the insulating layer 26*e* and is connected to the connection portion 16*f* at its lower end portion.

The inter-layer connection conductor v3 (an example of a third inter-layer connection conductor) passes through the insulating layers 26*b* to 26*d* in the vertical direction in the area A3, when viewed from the upper side, and forms a substantially linear shape extending in the front-and-back direction. The inter-layer connection conductor v3 is also provided on the top face of the insulating layer 26*e*. The inter-layer connection conductor v3 is positioned near the front end of the right long side of the area A3, when viewed from the upper side.

The extended conductor layer 45*a* is provided on the top face of the insulating layer 26*c*. The extended conductor layer 45*a* is connected to the end portion at the inner side of the coil conductor layer 34*a* and is connected to the inter-layer connection conductor v3. Accordingly, the inter-layer connection conductor v3 is electrically connected to the end portion at the inner side of the coil conductor layer 34*a*. The extended conductor layer 45*a* does not form a spiral shape, when viewed from the upper side, and extends leftward from the end portion at the inner side of the coil conductor layer 34*a*. The boundary between the coil conductor layer 34*a* and the extended conductor layer 45*a* is at a position where the extended conductor layer 45*a* steps away from the spiral path formed by the coil conductor layer 34*a*.

The extended conductor layer 64 (an example of a third extended conductor layer) is provided on the top face of the insulating layer 26*b*. The extended conductor layer 64 is connected to the inter-layer connection conductor v3 and is also connected to the connection conductor 70*f*. More specifically, the extended conductor layer 64 has an end portion t11 and an end portion t12. The end portion t11 of the extended conductor layer 64 is connected to the inter-layer connection conductor v3. The end portion t12 of the extended conductor layer 64 is positioned near the right face of the main body 12, compared with the coil conductor layer 34*a*, when viewed from the upper side, and overlaps with the outer electrode 14*f*. In addition, the end portion t12 of the extended conductor layer 64 is connected to the connection conductor 70*f*. Accordingly, the end portion t6 of the tertiary coil L3 (the end portion at the inner side of the coil conductor layer 34*a*) is connected to the outer electrode 14*f* with the extended portion 55 (the inter-layer connection conductor v3, the extended conductor layers 45*a* and 64, and the connection conductor 70*f*) and the connection portion 16*f* interposed therebetween.

The coil conductor layers 30*a*, 32*a*, and 34*a*, the extended conductor layers 40*a*, 41*a*, 42*a*, 43*a*, 44*a*, 45*a*, 60, 62, and 64, and the connection conductors 70*a* to 70*f* are each manufactured using substantially the same material and substantially the same method as those of the outer electrodes 14*a* to 14*f*.

As illustrated in FIG. 3, the cross-sectional area of the coil conductor layer 30*a*, the cross-sectional area of the coil conductor layer 32*a*, and the cross-sectional area of the coil conductor layer 34*a* are substantially equal to each other. Accordingly, the line width of the coil conductor layer 30*a*, the line width of the coil conductor layer 32*a*, and the line width of the coil conductor layer 34*a* are substantially equal to each other. In addition, the thickness of the coil conductor layer 30*a*, the thickness of the coil conductor layer 32*a*, and the thickness of the coil conductor layer 34*a* are substantially equal to each other. The cross-sectional area of the coil conductor layer in the above description means the cross-sectional area of a cross section perpendicular to the direction in which the coil conductor layer extends. The thickness of the coil conductor layer means the thickness in the vertical direction of the coil conductor layer. The line width of the coil conductor layer means the width in a direction perpendicular to the vertical direction of the coil conductor layer on the cross section perpendicular to the direction in which the coil conductor layer extends.

The spacing between the coil conductor layer 30*a* and the coil conductor layer 32*a* is substantially equal to the spacing between the coil conductor layer 32*a* and the coil conductor layer 34*a*. In other words, the vertical spacings between adjacent coil conductor layers, among the coil conductor layers 30*a*, 32*a*, and 34*a*, are substantially equal to each other. The spacing between the coil conductor layers means the distance between opposing faces of two coil conductor layers.

The magnetic core 100 vertically passes through the insulating layer 26*a* to 26*e* (an example of multiple first insulating layers) so as to vertically pass through the coil conductor layers 30*a*, 32*a*, and 34*a* at the center of an area A (refer to FIG. 3), when viewed from the upper side. The area A (an example of a certain area) is an area in which the three areas: the area A1, the area A2, and the area A3 overlap with each other, when viewed from the upper side. In other words, the area A is an area formed by overlapping of the areas A1 to A3, when viewed from the upper side, and is a substantially rectangular area surrounded by the coil conductor layers 30*a*, 32*a*, and 34*a*. The length in the left-and-right direction of the area A is shorter than the length in the front-and-back direction of the area A. The center of the area A is, for example, the centroid (the intersection of diagonal lines) of the area A, when viewed from the upper side. The magnetic core 100 forms a substantially rectangular shape having long sides extending in the front-and-back direction and short sides extending in the left-and-right direction, when viewed from the upper side. The magnetic core 100 has a permeability higher than that of the insulating layer 26*a* to 26*e*. The magnetic core 100 is made of substantially the same material as that of the magnetic substrates 20*a* and 20*b*.

The positional relationship among the magnetic core 100, the inter-layer connection conductors v1 to v3, the end portions t7, t9, and t11 of the extended conductor layers 60, 62, and 64, and the end portions t1 to t6 of the coil conductor layers 30*a*, 32*a*, and 34*a* will now be described. The inter-layer connection conductors v1 to v3 are not positioned on the left side (an example of one side of the second perpendicular direction) of the magnetic core 100, when viewed from the upper side, as illustrated in FIG. 2. In the electronic component 10 according to the present embodiment, the inter-layer connection conductors v1 to v3 are positioned on the right side of a rightmost (an example of the other side of the second perpendicular direction) portion of the magnetic core 100, when viewed from the upper side. The rightmost portion of the magnetic core 100, when viewed from the upper side, is the right long side of the magnetic core 100. The inter-layer connection conductors v1 to v3 are arranged in line in this order from the back side to the front side along the right long side of the magnetic core 100, when viewed from the upper side. In addition, the magnetic core 100 overlaps with the center of the area A, when viewed from the upper side. Accordingly, the inter-layer connection conductors v1 to v3 are not positioned at the center of the area A, when viewed from the upper side.

The end portions t7, t9, and t11 of the extended conductor layers 60, 62, and 64 are connected to the inter-layer connection conductors v1 to v3, respectively. The inter-layer connection conductors v1 to v3 are arranged in line in this order from the back side to the front side along the right long side of the magnetic core 100, when viewed from the upper side. Accordingly, the end portions t7, t9, and t11 are arranged in line in this order from the back side to the front side along the right long side of the magnetic core 100, when viewed from the upper side.

The end portions t1, t3, and t5 of the coil conductor layers 30*a*, 32*a*, and 34*a* are positioned on the left side of a leftmost portion of the magnetic core 100, when viewed from the upper side. In other words, the end portions t1, t3, and t5 are positioned on the left side of the left long side of the magnetic core 100, when viewed from the upper side. In addition, the end portions t1, t3, and t5 are arranged in this order from the back side to the front side, when viewed from the upper side. The end portions t2, t4, and t6 of the coil conductor layers 30*a*, 32*a*, and 34*a* are positioned on the right side of the rightmost portion of the magnetic core 100, when viewed from the upper side. In other words, the end portions t2, t4, and t6 are positioned on the right side of the right long side of the magnetic core 100, when viewed from the upper side. In addition, the end portions t2, t4, and t6 are arranged in this order from the back side to the front side, when viewed from the upper side.

Since the outer electrodes 14*a* and 14*d*, the end portions t1 and t2 of the coil conductor layer 30*a*, the end portion t7 of the extended conductor layer 60, and the inter-layer connection conductor v1 are electrically connected to each other, the outer electrodes 14*a* and 14*d*, the end portions t1 and t2 of the coil conductor layer 30*a*, the end portion t7 of the extended conductor layer 60, and the inter-layer connection conductor v1 are referred to as a first group. Since the outer electrodes 14*b* and 14*e*, the end portions t3 and t4 of the coil conductor layer 32*a*, the end portion t9 of the extended conductor layer 62, and the inter-layer connection conductor v2 are electrically connected to each other, the outer electrodes 14*b* and 14*e*, the end portions t3 and t4 of the coil conductor layer 32*a*, the end portion t9 of the extended conductor layer 62, and the inter-layer connection conductor v2 are referred to as a second group. Since the outer electrodes 14*c* and 14*f*, the end portions t5 and t6 of the coil conductor layer 34*a*, the end portion t11 of the extended conductor layer 64, and the inter-layer connection conductor v3 are electrically connected to each other, the outer electrodes 14*c* and 14*f*, the end portions t5 and t6 of the coil conductor layer 34*a*, the end portion t11 of the extended conductor layer 64, and the inter-layer connection conductor v3 are referred to as a third group. Since the inter-layer connection conductors v1 to v3, the end portions t7, t9, and t11 of the extended conductor layers 60, 62, and 64, and the end portions t1 to t6 of the coil conductor layers 30*a*, 32*a*, and 34*a* have the above positional relationship, the first group, the second group, and the third group are arranged in this order from the back side to the front side, when viewed from the upper side.

An exemplary operation of the electronic component 10 having the above structure will now be described. The outer electrodes 14*a* to 14*c* are used as, for example, input terminals. The outer electrodes 14*d* to 14*f* are used as, for example, output terminals. The primary coil L1, the secondary coil L2, and the tertiary coil L3 are magnetically coupled to each other.

A first signal S1 is input into the outer electrode 14*a*, a second signal S2 is input into the outer electrode 14*b*, and a third signal S3 is input into the outer electrode 14*c*. It is assumed that the first signal S1, the second signal S2, and the third signal S3 described below are used. The first signal S1, the second signal S2, and the third signal S3 take three different arbitrary voltage values: High (H), Middle (M), and Low (L) and make a transition between the three values: H, M, and L at the same clock. In addition, at a timing when a signal takes a value of H, one of the remaining two signals takes a value of M and the other of the remaining two signals takes a value of L. In other words, the first signal S1, the second signal S2, and the third signal S3 exclusively make a transition between the three values: H, M, and L. Here, the sum of the voltage values of the first signal S1, the second signal S2, and the third signal S3 is kept at an almost constant value (H+M+L) and the "total" amount of change in the voltage due to the transition is substantially equal to zero. Accordingly, the "total" amount of change in current occurring in the primary coil L1, the secondary coil L2, and the tertiary coil L3 is substantially equal to zero and the amount of change in magnetic flux occurring in the electronic component 10 is substantially equal to zero (although the magnetic flux occurring in each of the primary coil L1, the secondary coil L2, and the tertiary coil L3 is varied, the variations in the magnetic flux are offset). Since impedance does not substantially occur in the electronic component 10 when the magnetic flux is not substantially changed, as described above, the electronic component 10 does not affect the first signal S1, the second signal S2, and the third signal S3.

In contrast, the magnetic fluxes caused by the primary coil L1, the secondary coil L2, and the tertiary coil L3 are varied in substantially the same direction for common mode noise, that is, for noise of substantially the same phase included in the first signal S1, the second signal S2, and the third signal S3 and the variations in the magnetic flux are not offset and reinforced. Accordingly, the electronic component 10 has high impedance for the common mode noise and, thus, is capable of reducing the common mode noise. As described above, the electronic component 10 does not affect the first signal S1, the second signal S2, and the third signal S3 and is capable of reducing the common mode noise. The primary coil L1, the secondary coil L2, and the tertiary coil L3 compose a common mode filter for the first signal S1, the second signal S2, and the third signal S3. The "common mode filter" means a function to greatly reduce the common mode noise, compared with the effect on the first signal S1, the second signal S2, and the third signal S3, or a device having the function.

(Method of Manufacturing Electronic Component)

An exemplary method of manufacturing the electronic component 10 will now be described with reference to the drawings. Although a case will be exemplified in which one electronic component 10 is manufactured, practically, a large mother magnetic substrate and mother insulating layers are laminated to manufacture a mother board and the mother board is cut to manufacture multiple electronic components 10 at one time.

First, polyimide resin, which is photosensitive resin, is applied on the entire top face of the magnetic substrate 20*b*. Next, the positions corresponding to the four corners and the central portions of the two long sides of the insulating layer 26*e* are shaded for exposure. This hardens the polyimide resin in an unshaded portion. Then, the polyimide resin that is not hardened is removed by removing photoresist with organic solvent and performing development and thermosetting is performed. This forms the insulating layer 26*e*.

Next, an Ag film is formed on the insulating layer 26*e* and the magnetic substrate 20*b* exposed from the insulating layer 26*e* using the sputtering method. Next, the photoresist is formed on a portion where the coil conductor layer 30*a*, the extended conductor layers 40*a* and 41*a*, the connection conductors 70*a* to 70*f*, and the inter-layer connection conductors v1 to v3 are to be formed. The Ag film on the portion excluding the portion where the coil conductor layer 30*a*, the extended conductor layers 40*a* and 41*a*, the connection conductors 70*a* to 70*f*, and the inter-layer connection conductors v1 to v3 are to be formed (that is, the portion covered with the photoresist) is removed using an etching method. Then, the photoresist is removed with the organic solvent to form the coil conductor layer 30*a*, the extended conductor layers 40*a* and 41*a*, part of the connection conductors 70*a* to 70*f* (one layer), and part of the inter-layer connection conductors v1 to v3 (one layer).

The same process as the above one is repeated to form the insulating layers 26*a* to 26*d*, the coil conductor layers 32*a* and 34*a*, the extended conductor layers 42*a*, 43*a*, 44*a*, 45*a*, 60, 62, and 64, the remaining portion of the connection conductors 70*a* to 70*f*, and the remaining portion of the inter-layer connection conductors v1 to v3.

Next, the multilayer body 22 is irradiated with laser beams from the upper side to form a through hole. The through hole is filled with the magnetic paste. This forms the magnetic core 100.

Next, the magnetic paste to be used as the magnetic layer 24 is applied on the multilayer body 22 and the magnetic substrate 20*a* is pressure-bonded on the magnetic layer 24.

Next, the six notches are formed on the magnetic substrate 20*b* using a sandblasting method. The notches may be formed using a laser processing method, instead of the sandblasting method, or may be formed using a combination of the sandblasting method and the laser processing method.

Finally, the conductor layers are formed on the inner peripheries of the notches of the magnetic substrate 20*b* using a combination of an electric field plating method and a photolithographic method to form the connection portions 16*a* to 16*f* and the outer electrodes 14*a* to 14*f*.

(Advantages)

With the electronic component 10 according to the present embodiment, a large area where the magnetic core is capable of being arranged is ensured in the area A surrounded by the coil conductor layers 30*a*, 32*a*, and 34*a*. More specifically, in the common mode choke coil 510 described in Japanese Unexamined Patent Application Publication No. 2006-237080, the through-hole conductors 530, 532, and 534 are positioned near the centers of areas surrounded by the coil conductors 514, 516, and 518, respectively. Accordingly, in the common mode choke coil 510, the areas surrounded by the coil conductors 514, 516, and 518 are divided by the through-hole conductors 530, 532, and 534 near the centers and it is difficult to ensure a large area where the magnetic core is capable of being arranged.

In contrast, in the electronic component 10, the inter-layer connection conductors v1 to v3 are not positioned on the left side of the leftmost portion of the magnetic core 100 (the left long side of the magnetic core 100), when viewed from the upper side, as illustrated in FIG. 2. Accordingly, a large area where the magnetic core is capable of being arranged is ensured on the left side of the center of the area A. As a result, it is possible to ensure a large area where the magnetic core is capable of being arranged in the area A surrounded by the coil conductor layers 30*a*, 32*a*, and 34*a*.

With the electronic component 10, the area of the magnetic core 100 is made large, when viewed from the upper side. More specifically, with the electronic component 10, a large area where the magnetic core 100 is capable of being arranged is ensured on the left side of the center of the area A, as described above. In other words, the left side of the magnetic core 100 comes close to the left side of the area A, when viewed from the upper side. The length of the area A in the front-and-back direction is longer than the length of the area A in the left-and-right direction in the electronic component 10. The left side of the area A is a long side and the left side of the magnetic core 100, which opposes the left long side of the area A, is also a long side. The area increased by movement of the long sides is larger than the area increased by movement of the short sides. Accordingly, in the magnetic core 100, the area of the magnetic core 100 increased by bringing the left long side of the magnetic core 100 close to the left long side of the area A is made large. As a result, it is possible to make the area of the magnetic core 100 large, when viewed from the upper side, in the electronic component 10.

In addition, with the electronic component 10, the area of the magnetic core 100 is made large, when viewed from the upper side. More specifically, the extended conductor layers 60, 62, and 64 connect the inter-layer connection conductors v1 to v3 to the connection conductors 70*d* to 70*f*, respectively. The connection conductors 70*d* to 70*f* are connected to the outer electrodes 14*d* to 14*f*, which are provided immediately below the connection conductors 70*d* to 70*f*, respectively. The inter-layer connection conductors v1 to v3 are arranged in this order from the back side to the front side and the outer electrodes 14*d* to 14*f* are also arranged in this order from the back side to the front side. Accordingly, the inter-layer connection conductors v1 to v3 oppose the connection conductors 70*d* to 70*f*, respectively. This enables the extended conductor layers 60, 62, and 64 to linearly connect the inter-layer connection conductors v1 to v3 to the connection conductors 70*d* to 70*f*, respectively, with small lengths. Consequently, it is sufficient to provide a small space where the extended conductor layers 60, 62, and 64 are to be provided between the inter-layer connection conductors v1 to v3 and the right face of the main body 12. As a result, the inter-layer connection conductors v1 to v3 come close to the right face of the main body 12. In other words, it is possible to bring the right long side of the magnetic core 100 close to the right face of the main body 12, when viewed from the upper side. As a result, it is possible to make the area of the magnetic core 100 large, when viewed from the upper side.

Furthermore, with the electronic component 10, the area of the magnetic core 100 is made large, when viewed from the upper side, also for the following reason. More specifically, the inter-layer connection conductors v1 to v3 are positioned on the right side of the rightmost portion of the magnetic core 100 (the right long side of the magnetic core 100), when viewed from the upper side, in the electronic component 10, as illustrated in FIG. 2. Accordingly, the inter-layer connection conductors v1 to v3 are not arranged on the front side and the back side of the magnetic core 100. Consequently, it is possible to expand the magnetic core 100 forward and backward.

Furthermore, with the electronic component 10, the area of the magnetic core 100 is made large, when viewed from the upper side. More specifically, the extended conductor layers 40*a*, 42*a*, and 44*a* connect the end portions t1, t3, and t5 of the coil conductor layers 30*a*, 32*a*, and 34*a* to the connection conductors 70*a* to 70*c*, respectively. The connection conductors 70*a* to 70*c* are connected to the outer electrodes 14*a* to 14*c*, which are provided immediately below the connection conductors 70*a* to 70*c*, respectively. The end portions t1, t3, and t5 are arranged in this order from the back side to the front side and the outer electrodes 14*a* to 14*c* are also arranged in this order from the back side to the front side. Accordingly, the end portions t1, t3, and t5 oppose the connection conductors 70*a* to 70*c*, respectively. This enables the extended conductor layers 40*a*, 42*a*, and 44*a* to linearly connect the end portions t1, t3, and t5 to the connection conductors 70*a* to 70*c*, respectively, with small lengths. Consequently, it is sufficient to provide a small space where the extended conductor layers 40*a*, 42*a*, and 44*a* are to be provided between the end portions t1, t3, and t5 and the left face of the main body 12. As a result, the end portions t1, t3, and t5 come close to the left face of the main body 12. In other words, it is possible to bring the left long side of the magnetic core 100 close to the left face of the main body 12, when viewed from the upper side. As a result, it is possible to make the area of the magnetic core 100 large, when viewed from the upper side.

When the primary coil, the secondary coil, and the tertiary coil compose a common mode filter, the lengths of current paths of the primary coil, the secondary coil, and the tertiary coil are preferably equal to each other in order to achieve excellent characteristics of the common mode filter.

The reason that the lengths of the current paths of the primary coil, the secondary coil, and the tertiary coil are preferably equal to each other will now be described. First, in order to confirm that no impedance is caused for the first signal S1, the second signal S2, and the third signal S3, a case will be considered in which the voltages of the first signal S1, the second signal S2, and the third signal S3 are varied in the following manner:

S1: varied from V1 to V1'

S2: varied from V2 to V2'

S3: varied from V3 to V3'

Here, ΔI is calculated according to the following equation:

$$\Delta I=(V1'-V1)/L1+(V2'-V2)/L2+(V3'-V3)/L3=\{L2\cdot L3(V1'-V1)+L3\cdot L1(V2'-V2)+L1\cdot L2(V3'-V3)\}/(L1\cdot L2\cdot L2)$$

where ΔI denotes the total amount of change in current of the primary coil L1, the secondary coil L2, and the tertiary coil L3.

ΔI is calculated according to the following equation if L1≈L2≈L3≈L:

$$\Delta I=\{(V1'+V2'+V3')-(V1+V2+V3)\}/L$$

V1'+V2'+V3' is substantially equal to V1+V2+V3 from the definition of the first signal S1, the second signal S2, and the third signal S3. Accordingly, ΔI is substantially equal to 0. In other words, when V1 to V3 are exclusively varied between H, M, and L, the total amount of change in current ΔI is substantially equal to zero and the amount of change in magnetic flux is also substantially equal to zero. Accordingly, the impedance for the first signal S1, the second signal S2, and the third signal S3 is substantially equal to zero and the waveforms of the first signal S1, the second signal S2, and the third signal S3 are kept. In contrast, when the lengths of the current paths are varied, L1≠L2≠L3. Accordingly, the premise L1≈L2≈L3≈L is denied. As a result, the total amount of change in current ΔI is not equal to zero and the waveforms of the first signal S1, the second signal S2, and the third signal S3 may be affected. Accordingly, the lengths of the current paths of the primary coil, the secondary coil, and the tertiary coil are preferably equal to each other.

However, it is difficult to equalize the lengths of the current paths of the primary coil L1, the secondary coil L2, and the tertiary coil L3 in the electronic component 10, as described below. More specifically, in the electronic component 10, the outer electrodes 14*a* to 14*c* are arranged in this order from the back side to the front side and the outer electrodes 14*d* to 14*f* are arranged in this order from the back side to the front side. Each of the coil conductor layers 30*a*, 32*a*, and 34*a* forms a spiral shape in which the coil conductor winds clockwise from the outer side to the inner side, when viewed from the upper side. Accordingly, the length of the primary coil L1 is about n1+0.25 turns, the length of the secondary coil L2 is about n2+0.5 turns, and the length of the primary coil L1 is about n3+0.75 turns. Here, each of n1, n2, and n3 is an integer not less than zero. Accordingly, the lengths of the current paths of the primary coil L1, the secondary coil L2, and the tertiary coil L3 are not equalized.

For the above reason, it is difficult to equalize the lengths of the current paths of the primary coil L1, the secondary coil L2, and the tertiary coil L3 in the electronic component 10.

Changing the order in which the outer electrodes 14*a* to 14*c* are arranged or the order in which the outer electrodes 14*d* to 14*f* are arranged may equalize the lengths of the current paths of the primary coil L1, the secondary coil L2, and the tertiary coil L3. However, in this case, the position in the front-and-back direction of the outer electrode into which an input signal is input does not coincide with the position in the front-and-back direction of the outer electrode from which an output signal is output. Such an electronic component is not user-friendly. Accordingly, it is difficult to equalize the lengths of the current paths of the primary coil L1, the secondary coil L2, and the tertiary coil L3 in the electronic component 10 also from this point of view.

However, even when the lengths of the current paths of the primary coil L1, the secondary coil L2, and the tertiary coil L3 are different from each other in the electronic component 10, the performance of the common mode filter is not greatly affected, as described below.

More specifically, three parameters indicating the characteristics of the common mode filter are used in the electronic component 10. The three parameters are differential impedance among the primary coil L1, the secondary coil L2, and the tertiary coil L3 (hereinafter simply referred to as differential impedance), common mode impedance, and a cutoff frequency. The inventors of the present disclosure have found that the differential impedance and the common mode impedance are not greatly affected by the difference in the lengths of the current paths of the primary coil L1, the secondary coil L2, and the tertiary coil L3. In contrast, the inventors of the present disclosure have found that the cutoff frequency is affected by variation in the lengths of the current paths of the primary coil L1, the secondary coil L2, and the tertiary coil L3.

In the electronic component 10, the first signal S1, the second signal S2, and the third signal S3 are supplied to the primary coil L1, the secondary coil L2, and the tertiary coil L3, respectively, as described above. The electronic component 10 reduces the common mode noise included in the first signal S1, the second signal S2, and the third signal S3 while keeping the waveforms of the first signal S1, the second signal S2, and the third signal S3.

The inventors of the present disclosure have found that, in this case, the degree of degradation of the cutoff frequency is within an allowable range even if the cutoff frequency is degraded due to the non-uniformity of the lengths of the current paths of the primary coil L1, the secondary coil L2, and the tertiary coil L3. Accordingly, in the electronic component 10, the provision of the magnetic core 100 achieves the excellent characteristics of the common mode filter even if the lengths of the current paths of the primary coil L1, the secondary coil L2, and the tertiary coil L3 are not equalized.

Figure 4:
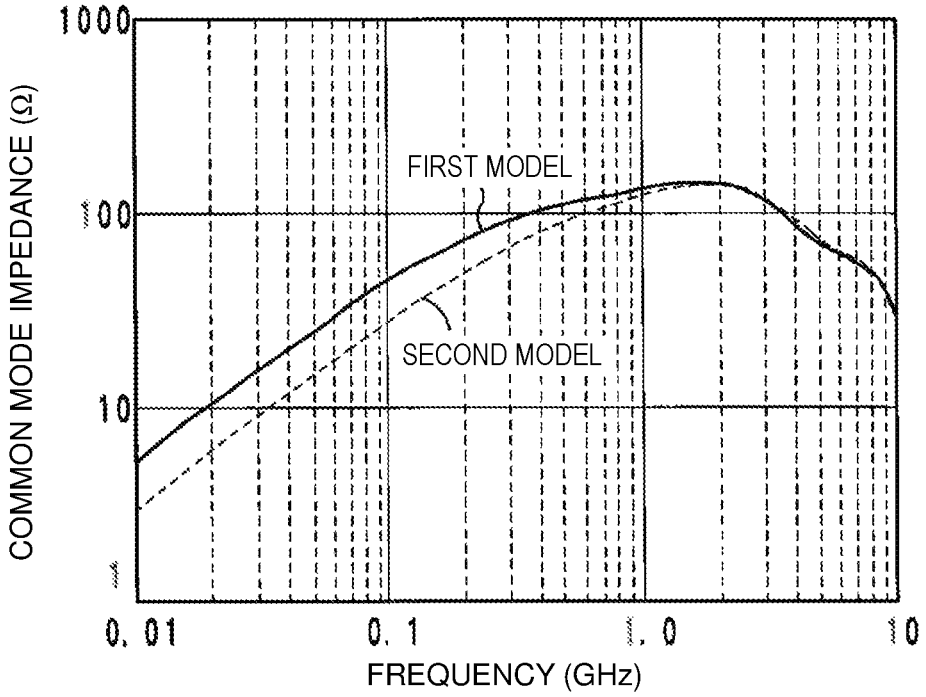
FIG. 4 is a graph illustrating a result of a simulation.

The inventors of the present disclosure performed a computer simulation described below in order to clarify the advantages of the electronic component 10. More specifically, the inventors of the present disclosure created a first model having the structure of the electronic component 10. In addition, the inventors of the present disclosure created a second model having a structure in which the magnetic core 100 is not provided in the electronic component 10. The first model is an embodiment and the second model is a comparative example. The common mode impedances of the first model and the second model were calculated using a computer. FIG. 4 is a graph illustrating a result of the simulation. Referring to FIG. 4, the vertical axis represents common mode impedance and the horizontal axis represents frequency. The following simulation conditions were used.

In the first model, the magnetic core 100 was made of substantially the same material as that of the insulating layer 26*a* to 26*e* in the configuration in FIG. 2. In the second model, resin containing magnetic filler (having a permeability of five) was used for the magnetic core 100 in the configuration in FIG. 2.

FIG. 4 indicates that the common mode impedance of the first model is higher than the common mode impedance of the second model from about 100 MHz to about 1 GHz. Specifically, FIG. 4 indicates that the first model is capable of effectively reducing the common mode noise from a high-frequency signal from about 100 MHz to about 1 GHz. In other words, the computer simulation indicates that the arrangement of the magnetic core 100 enables the electronic component 10 to have excellent common mode impedance.

(First Modification)

Figure 5:
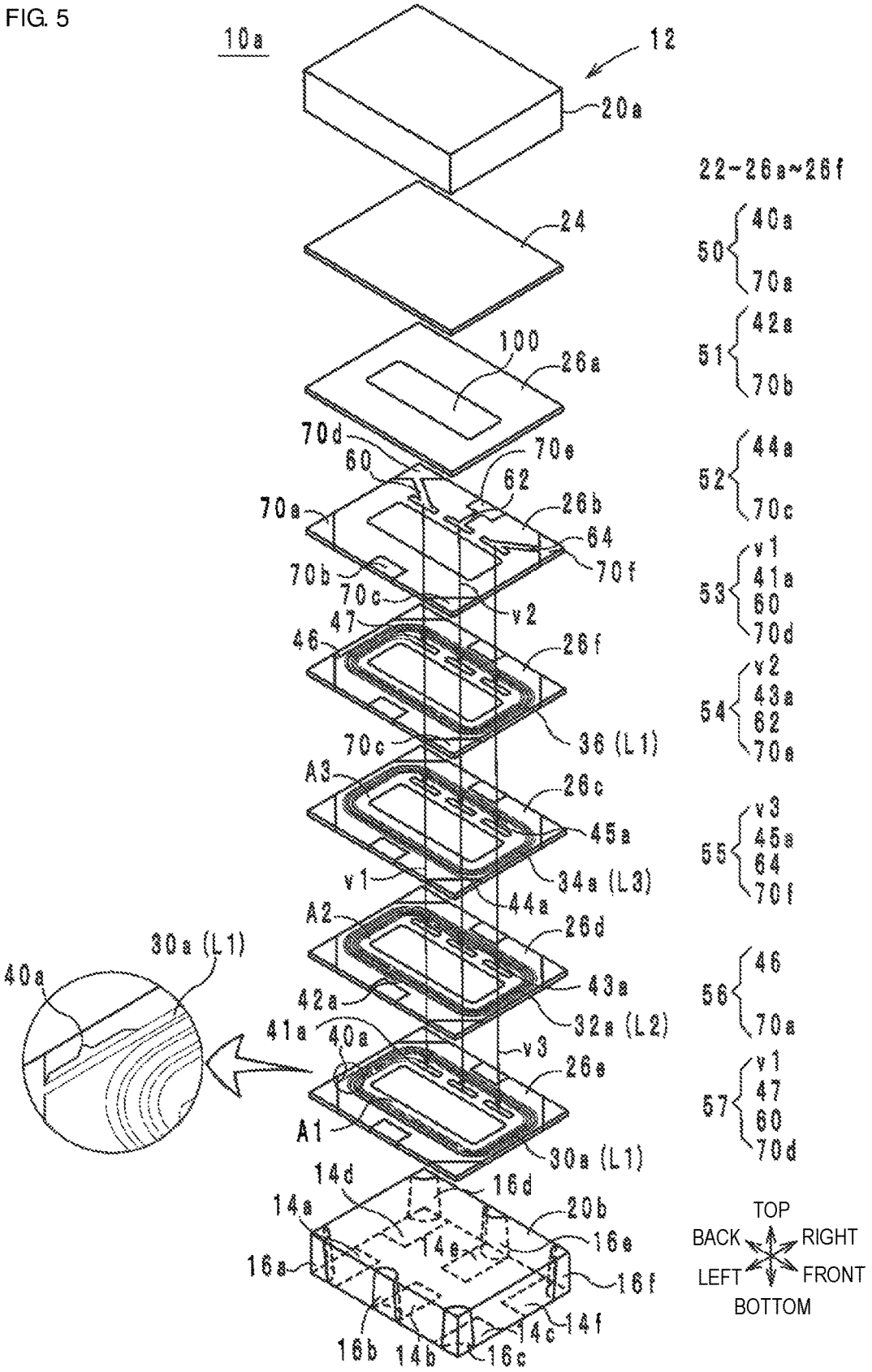
FIG. 5 is an exploded perspective view of an electronic component according to a first modification.
Figure 6:
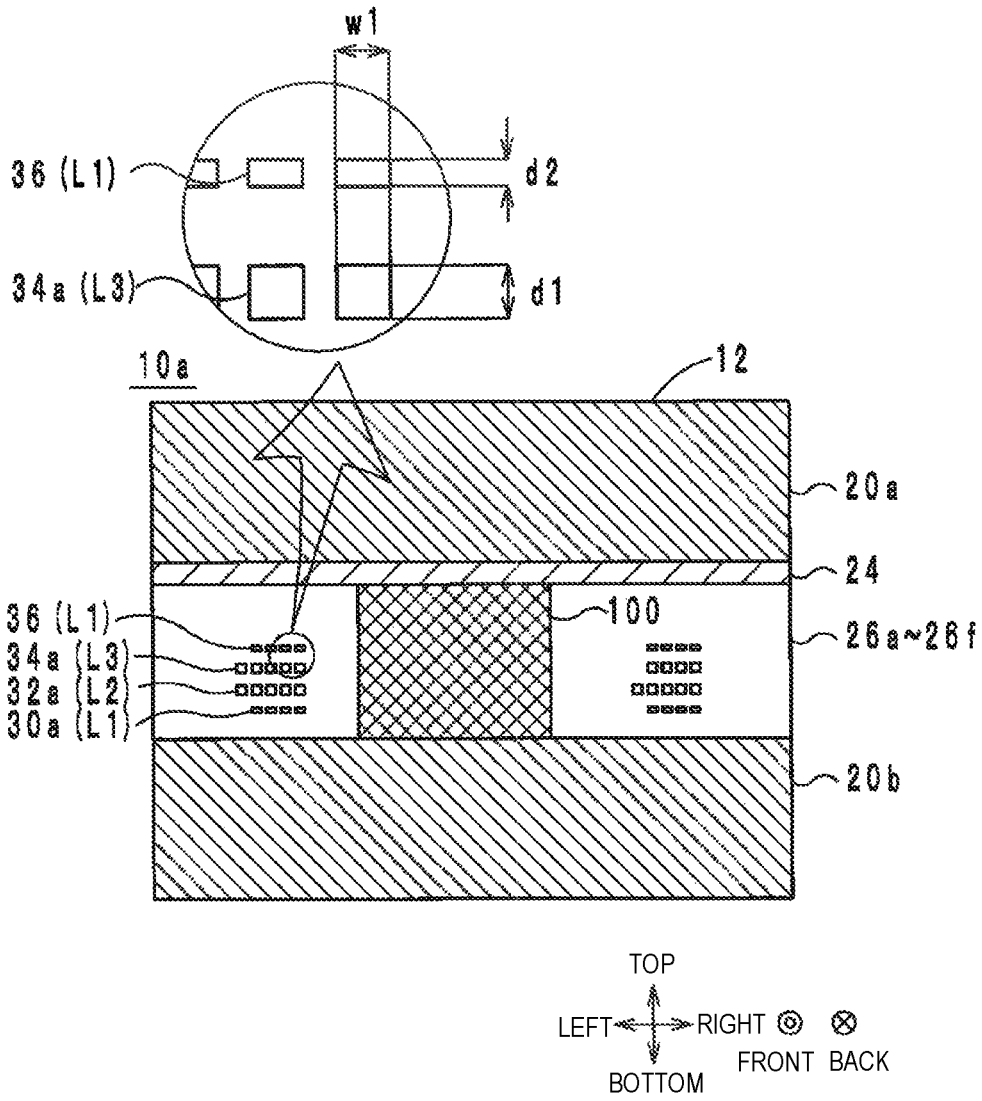
FIG. 6 is a cross-sectional view illustrating an exemplary structure of the electronic component in FIG. 5.

An electronic component 10*a* according to a first modification will now be described with reference to the drawings. FIG. 5 is an exploded perspective view of the electronic component 10*a*. FIG. 6 is a cross-sectional view illustrating an exemplary structure of the electronic component 10*a* in FIG. 5. The cross-sectional view illustrating an exemplary structure of the electronic component 10*a* in FIG. 6 corresponds to the cross-sectional view illustrating an exemplary structure of the electronic component 10 in FIG. 3. The external perspective view of the electronic component 10*a* is substantially the same as that of the electronic component 10 in FIG. 1.

The electronic component 10*a* differs from the electronic component 10 in that the electronic component 10*a* includes an insulating layer 26*f*, a parallel coil conductor layer 36, and extended portions 56 and 57. The electronic component 10*a* will be described, focusing on the difference.

The insulating layer 26*f* is provided between the insulating layer 26*b* and the insulating layer 26*c*. The primary coil L1 further includes the parallel coil conductor layer 36 (an example of a parallel primary coil conductor layer). The parallel coil conductor layer 36 has substantially the same shape as that of the coil conductor layer 30*a* and is electrically connected in parallel to the coil conductor layer 30*a*. The parallel coil conductor layer 36 is provided at the upper side of the coil conductor layer 34*a*, which is the uppermost coil conductor layer among the coil conductor layers 30*a*, 32*a*, and 34*a*. The parallel coil conductor layer 36 is provided on the top face of the insulating layer 26*f* and forms a spiral shape in which the coil conductor winds clockwise from the outer side to the inner side, when viewed from the upper side.

The extended portion 56 connects the end portion at the outer side of the parallel coil conductor layer 36 to the outer electrode 14*a* and does not form a spiral shape, when viewed from the upper side, as illustrated in FIG. 5. The extended portion 56 includes an extended conductor layer 46 and the connection conductor 70*a*. Since the connection conductor 70*a* is described above, a detailed description of the connection conductor 70*a* is omitted herein. The extended conductor layer 46 is provided on the top face of the insulating layer 26*f*. The extended conductor layer 46 is connected to the end portion at the outer side of the parallel coil conductor layer 36 and is connected to the connection conductor 70*a*. The extended conductor layer 46 does not form a spiral shape, when viewed from the upper side, and extends leftward from the end portion at the outer side of the parallel coil conductor layer 36. Accordingly, the end portion at the outer side of the parallel coil conductor layer 36 is connected to the outer electrode 14*a* with the extended portion 56 (the extended conductor layer 46 and the connection conductor 70*a*) and the connection portion 16*a* interposed therebetween.

The extended portion 57 connects the end portion at the inner side of the parallel coil conductor layer 36 to the outer electrode 14*d* and does not form a spiral shape, when viewed from the upper side, as illustrated in FIG. 5. The extended portion 57 includes the inter-layer connection conductor v1, an extended conductor layer 47, the extended conductor layer 60, and the connection conductor 70*d*. Since the inter-layer connection conductor v1, the extended conductor layer 60, and the connection conductor 70*d* are described above, a detailed description of them is omitted herein. The extended conductor layer 47 is provided on the top face of the insulating layer 26*f*. The extended conductor layer 47 is connected to the end portion at the inner side of the parallel coil conductor layer 36 and is connected to the inter-layer connection conductor v1. The extended conductor layer 47 does not form a spiral shape, when viewed from the upper side, and extends toward the right front from the end portion at the inner side of the parallel coil conductor layer 36. The boundary between the parallel coil conductor layer 36 and the extended conductor layer 47 is at a position where the extended conductor layer 47 steps away from the spiral path formed by the parallel coil conductor layer 36. Accordingly, the end portion at the inner side of the parallel coil conductor layer 36 is connected to the outer electrode 14*d* with the extended portion 57 (the inter-layer connection conductor v1, the extended conductor layers 47 and 60, and the connection conductor 70*d*) and the connection portion 16*d* interposed therebetween. Consequently, the parallel coil conductor layer 36 is electrically connected in parallel to the coil conductor layer 30*a*.

The coil conductor layers 30*a*, 32*a*, and 34*a* and the parallel coil conductor layer 36 are configured so that the sum of the cross-sectional area of the coil conductor layer 30*a* and the cross-sectional area of the parallel coil conductor layer 36 are substantially equal to the cross-sectional area of the coil conductor layer 32*a* and the cross-sectional area of the coil conductor layer 34*a*. More specifically, as illustrated in FIG. 6, the line width of the coil conductor layer 30*a*, the line width of the coil conductor layer 32*a*, the line width of the coil conductor layer 34*a*, and the line width of the parallel coil conductor layer 36 has a substantially equal line width, which is a line width w1. However, the coil conductor layers 32*a* and 34*a* have a thickness d1 and the coil conductor layer 30*a* and the parallel coil conductor layer 36 have a thickness d2. The thickness d2 is substantially half of the thickness d1. Accordingly, the cross-sectional areas of the coil conductor layer 30*a* and the parallel coil conductor layer 36 are substantially equal to each other, which are substantially half of the cross-sectional areas of the coil conductor layers 32*a* and 34*a*. In other words, the sum of the cross-sectional area of the coil conductor layer 30*a* and the cross-sectional area of the parallel coil conductor layer 36 is substantially equal to the cross-sectional area of the coil conductor layer 32*a* and the cross-sectional area of the coil conductor layer 34*a*. The resistance values of the coil conductor layer 30*a* and the parallel coil conductor layer 36 are about twice the resistance values of the coil conductor layers 32*a* and 34*a*. The coil conductor layer 30*a* is electrically connected in parallel to the parallel coil conductor layer 36. Accordingly, in the current paths of the primary coil L1, the secondary coil L2, and the tertiary coil L3, the cross-sectional area of the primary coil L1, the cross-sectional area of the secondary coil L2, and the cross-sectional area of the tertiary coil L3 are substantially equal to each other. Consequently, the resistance values of the primary coil L1, the secondary coil L2, and the tertiary coil L3 come close to each other.

The spacing between the coil conductor layer 30*a* and the coil conductor layer 32*a*, the spacing between the coil conductor layer 32*a* and the coil conductor layer 34*a*, and the spacing between the coil conductor layer 34*a* and the parallel coil conductor layer 36 are substantially equal to each other. In other words, the vertical spacings between adjacent coil conductor layers, among the coil conductor layers 30*a*, 32*a*, and 34*a* and the parallel coil conductor layer 36, are substantially equal to each other. The spacing between the coil conductor layers means the distance between opposing faces of two coil conductor layers.

Also in the electronic component 10*a* having the above structure, it is possible to make the area of the magnetic core 100 large, when viewed from the upper side, as in the electronic component 10.

With the electronic component 10*a*, it is possible to reduce the difference in the differential impedance between the primary coil L1, the secondary coil L2, and the tertiary coil L3. More specifically, the differential impedance is represented by a square root of L/C where L denotes the inductance value and C denotes the capacitance value of the entire electronic component 10*a* including the coils when measurement current (or a differential signal) flows. The capacitance value C includes the capacitance (parasitic capacitance) between the coil conductor layers.

In the electronic component 10*a*, the parallel coil conductor layer 36 is provided at the upper side of the coil conductor layer 34*a*, which is the uppermost coil conductor layer among the coil conductor layers 30*a*, 32*a*, and 34*a*. This structure generates capacitance between the coil conductor layer 34*a* and the parallel coil conductor layer 36. Accordingly, the capacitance between the primary coil L1 and the secondary coil L2 is mainly formed by the capacitance between the coil conductor layer 30*a* and the coil conductor layer 32*a*. The capacitance between the secondary coil L2 and the tertiary coil L3 is mainly formed by the capacitance between the coil conductor layer 32*a* and the coil conductor layer 34*a*. The capacitance between the tertiary coil L3 and the primary coil L1 is mainly formed by the capacitance between the parallel coil conductor layer 36 and the coil conductor layer 34*a*. The capacitances among the primary coil L1, the secondary coil L2, and the tertiary coil L3 are based on, for example, the opposing areas and the spacings between the coil conductor layers 30*a*, 32*a*, 34*a* and/or the permittivities of the coil conductor layers 30*a*, 32*a*, and 34*a*. However, the capacitances among the primary coil L1, the secondary coil L2, and the tertiary coil L3 are substantially equal to each other. In other words, the capacitance values C between the differential impedances come close to each other. As a result, the differential impedance between the primary coil L1 and the secondary coil L2, the differential impedance between the secondary coil L2 and the tertiary coil L3, and the differential impedance between the tertiary coil L3 and the primary coil L1 come close to each other.

With the electronic component 10*a*, the cross-sectional area of the primary coil L1, the cross-sectional area of the secondary coil L2, and the cross-sectional area of the tertiary coil L3 are substantially equal to each other in the respective current paths of the primary coil L1, the secondary coil L2, and the tertiary coil L3, as described above. As a result, the electrical resistance value of the primary coil L1, the electrical resistance value of the secondary coil L2, and the electrical resistance value of the tertiary coil L3 come close to each other. Accordingly, it is possible to bring the amounts of current flowing through the primary coil L1 to the tertiary coil L3 close to each other and to bring the amounts of heat generation in the primary coil L1 to the tertiary coil L3 close to each other. In other words, it is possible to reduce the difference in loss between the first signal S1, the second signal S2, and the third signal S3.

The directionality of the electronic component 10*a* is lost when the resistance value of the primary coil L1, the resistance value of the secondary coil L2, and the resistance value of the tertiary coil L3 come close to each other. The outer electrodes 14*a* to 14*c* may be used as the input terminals and the outer electrodes 14*d* to 14*f* may be used as the output terminals. Alternatively, the outer electrodes 14*a* to 14*c* may be used as the output terminals and the outer electrodes 14*d* to 14*f* may be used as the input terminals. As a result, it is not necessary to identify the direction of the electronic component 10*a* in mounting and a direction identification mark is not required. Since the characteristics of the primary coil L1, the secondary coil L2, and the tertiary coil L3 come close to each other, the three signals may be input into any of the primary coil L1, the secondary coil L2, and the tertiary coil L3. As a result, the wiring layout on a circuit board on which the electronic component 10*a* is mounted is not limited by the electronic component 10*a*.

With the electronic component 10*a*, it is possible to bring the amount of heat generation in the coil conductor layer 30*a* close to the amount of heat generation in the parallel coil conductor layer 36. More specifically, the cross-sectional area of the coil conductor layer 30*a* is substantially equal to the cross-sectional area of the parallel coil conductor layer 36. In addition, the length of the coil conductor layer 30*a* is substantially equal to the length of the parallel coil conductor layer 36. Accordingly, the resistance value of the coil conductor layer 30*a* is substantially equal to the resistance value of the parallel coil conductor layer 36. Since the coil conductor layer 30*a* is electrically connected in parallel to the parallel coil conductor layer 36, the voltage applied to the coil conductor layer 30*a* is substantially equal to the voltage applied to the parallel coil conductor layer 36 and the current flowing through the coil conductor layer 30*a* is also substantially equal to the current flowing through the parallel coil conductor layer 36. Accordingly, the amount of heat generation in the coil conductor layer 30*a* is capable of being close to the amount of heat generation in the parallel coil conductor layer 36. Since the heat locally generated in the coil conductor layer 30*a* or the parallel coil conductor layer 36 is reduced, the variation in characteristics and the reliability of the electronic component 10*a* are improved.

(Second Modification)

Figure 7:
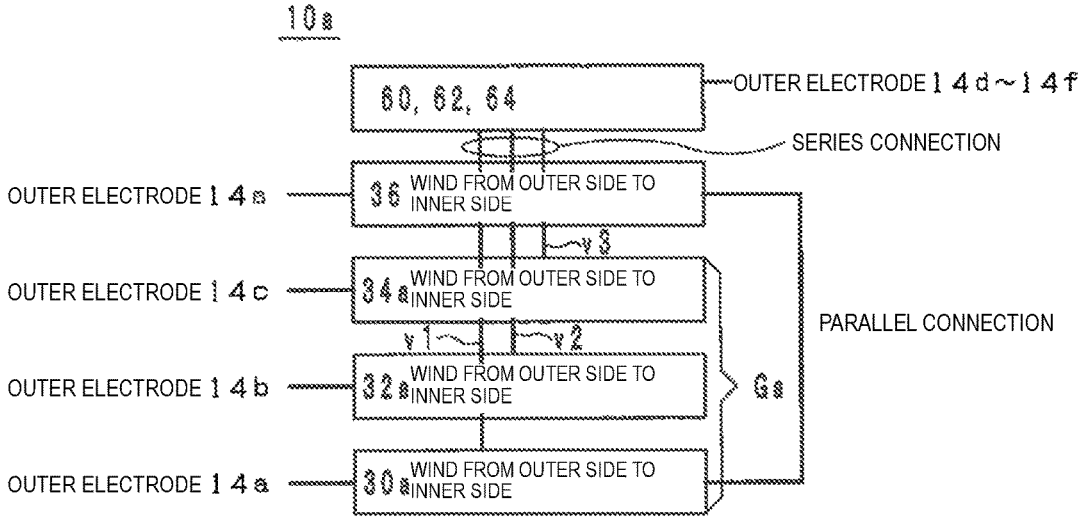
FIG. 7 is a schematic diagram illustrating the positional relationship between coil conductor layers and a parallel coil conductor layer in the electronic component according to the first modification.
Figure 8:
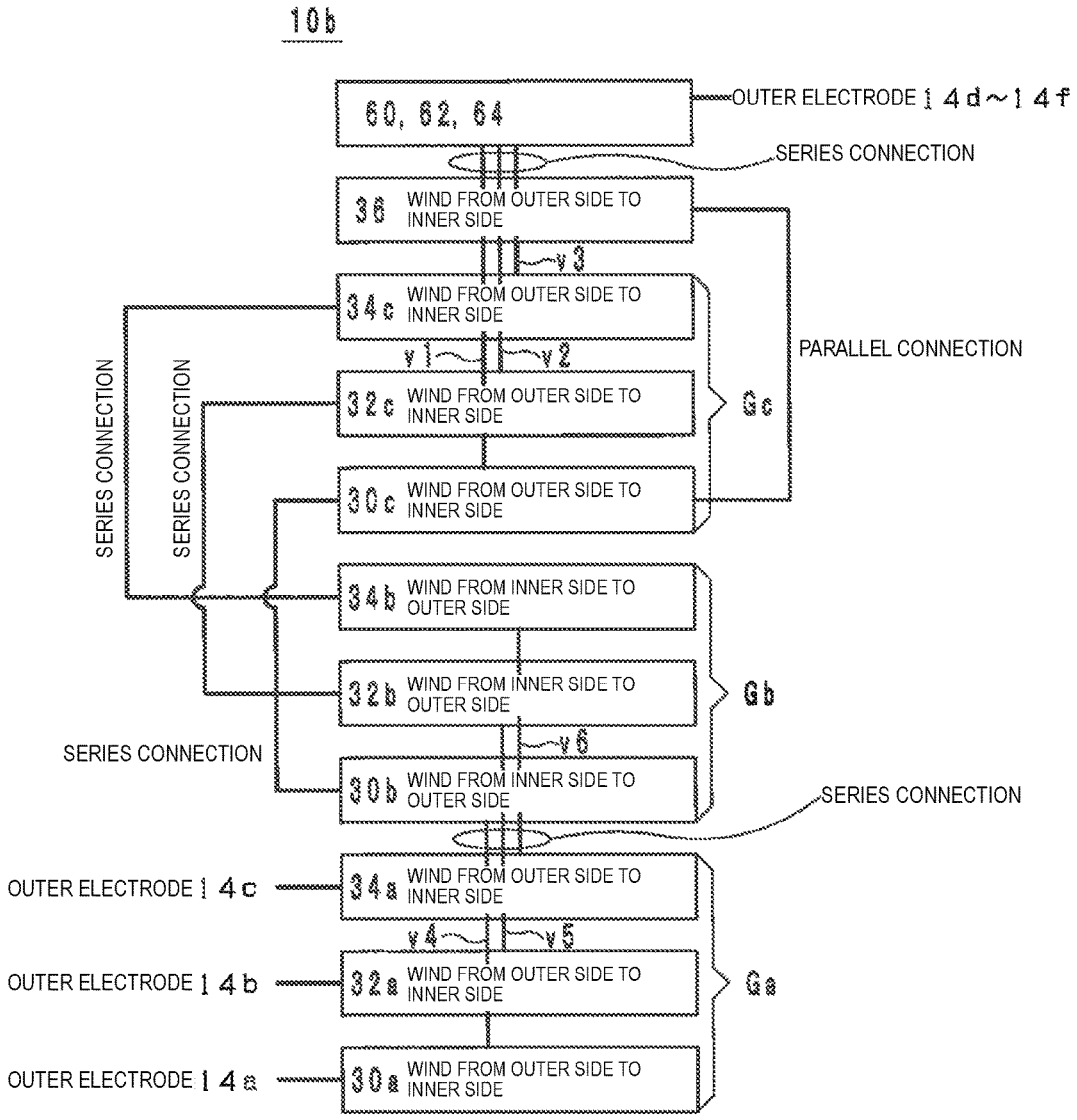
FIG. 8 is a schematic diagram illustrating the positional relationship between coil conductor layers and the parallel coil conductor layer in an electronic component according to a second modification.

An exemplary configuration of an electronic component 10*b* according to a second modification will now be described with reference to the drawings. FIG. 7 is a schematic diagram illustrating the positional relationship between the coil conductor layers 30*a*, 32*a*, and 34*a* and the parallel coil conductor layer 36 in the electronic component 10*a*. FIG. 8 is a schematic diagram illustrating the positional relationship between the coil conductor layers 30*a*, 32*a*, and 34*a*, coil conductor layer 30*b*, 32*b*, 34*b*, 30*c*, 32*c*, and 34*c*, and the parallel coil conductor layer 36 in the electronic component 10*b*.

In the electronic component 10*a*, the primary coil L1 includes one coil conductor layer 30*a* and one parallel coil conductor layer 36, the secondary coil L2 includes one coil conductor layer 32*a*, and the tertiary coil L3 includes one coil conductor layer 34*a*. In contrast, in the electronic component 10*b*, the primary coil L1 includes the three coil conductor layers 30*a*, 30*b*, and 30*c* (an example of the primary coil conductor layer) and one parallel coil conductor layer 36, the secondary coil L2 includes the three coil conductor layers 32*a*, 32*b*, and 32*c* (an example of the secondary coil conductor layer), and the tertiary coil L3 includes the three coil conductor layer 34*a*, 34*b*, and 34*c* (an example of the tertiary coil conductor layer). Accordingly, the electronic component 10*a* differs from the electronic component 10*b* in the arrangement of the coil conductor layers 30*a*, 32*a*, 34*a*, 30*b*, 32*b*, 34*b*, 30*c*, 32*c*, and 34*c* and the parallel coil conductor layer 36, as described below.

In the electronic component 10*a*, the arrangement of the coil conductor layer 30*a*, the coil conductor layer 32*a*, and the coil conductor layer 34*a* in this order from the lower side to the upper side forms one coil conductor layer group Ga, as illustrated in FIG. 7. The parallel coil conductor layer 36 has substantially the same shape as that of the coil conductor layer 30*a* and is electrically connected in parallel to the coil conductor layer 30*a*. In addition, the parallel coil conductor layer 36 is provided at the upper side of the uppermost coil conductor layer 34*a*.

In contrast, in the electronic component 10*b*, the arrangement of the coil conductor layer 30*a*, the coil conductor layer 32*a*, and the coil conductor layer 34*a* in this order from the lower side to the upper side forms one coil conductor layer group Ga, the arrangement of the coil conductor layer 30*b*, the coil conductor layer 32*b*, and the coil conductor layer 34*b* in this order from the lower side to the upper side forms one coil conductor layer group Gb, and the arrangement of the coil conductor layer 30*c*, the coil conductor layer 32*c*, and the coil conductor layer 34*c* in this order from the lower side to the upper side forms one coil conductor layer group Gc, as illustrated in FIG. 8. The coil conductor layer groups Ga, Gb, and Gc are arranged from the lower side to the upper side. The parallel coil conductor layer 36 has substantially the same shape as that of the coil conductor layer 30*c*, is electrically connected in parallel to the coil conductor layer 30*b*, and is provided at the upper side of the uppermost coil conductor layer 34*c*.

The coil conductor layer 30*a* and the coil conductor layer 30*c* form substantially the same shape and each form a spiral shape in which the coil conductor winds clockwise from the outer side to the inner side, when viewed from the upper side. The coil conductor layer 30*b* forms a spiral shape in which the coil conductor winds clockwise from the inner side to the outer side, when viewed from the upper side. The coil conductor layer 30*a*, the coil conductor layer 30*b*, and the coil conductor layer 30*c* (an example of the first coil conductor layer) are electrically connected in series to each other. The end portion at the outer side of the coil conductor layer 30*a* is the end portion t1 of the primary coil L1. The end portion at the inner side of the coil conductor layer 30*c* is the end portion t2 of the primary coil L1. The end portion at the inner side of the coil conductor layer 30*c* is electrically connected to the extended conductor layer 60 with the inter-layer connection conductor v1 interposed therebetween.

The coil conductor layer 32*a* and the coil conductor layer 32*c* form substantially the same shape and each form a spiral shape in which the coil conductor winds clockwise from the outer side to the inner side, when viewed from the upper side. The coil conductor layer 32*b* forms a spiral shape in which the coil conductor winds clockwise from the inner side to the outer side, when viewed from the upper side. The coil conductor layer 32*a*, the coil conductor layer 32*b*, and the coil conductor layer 32*c* (an example of the second coil conductor layer) are electrically connected in series to each other. The end portion at the outer side of the coil conductor layer 32*a* is the end portion t3 of the primary coil L2. The end portion at the inner side of the coil conductor layer 32*c* is the end portion t4 of the secondary coil L2. The end portion at the inner side of the coil conductor layer 32*c* is electrically connected to the extended conductor layer 62 with the inter-layer connection conductor v2 interposed therebetween.

The coil conductor layer 34*a* and the coil conductor layer 34*c* form substantially the same shape and each form a spiral shape in which the coil conductor winds clockwise from the outer side to the inner side, when viewed from the upper side. The coil conductor layer 34*b* forms a spiral shape in which the coil conductor winds clockwise from the inner side to the outer side, when viewed from the upper side. The coil conductor layer 34*a*, the coil conductor layer 34*b*, and the coil conductor layer 34*c* (an example of the third coil conductor layer) are electrically connected in series to each other. The end portion at the outer side of the coil conductor layer 34*a* is the end portion t5 of the tertiary coil L3. The end portion at the inner side of the coil conductor layer 34*c* is the end portion t6 of the tertiary coil L3. The end portion at the inner side of the coil conductor layer 34*c* is electrically connected to the extended conductor layer 64 with the inter-layer connection conductor v3 interposed therebetween.

The inter-layer connection conductors v1 to v3 in the electronic component 10*b* are positioned on the right side of the leftmost portion of the magnetic core 100, when viewed from the upper side, as in the electronic component 10.

In the electronic component 10*b*, the end portion at the inner side of the coil conductor layer 30*a* is connected to the end portion at the inner side of the coil conductor layer 30*b* with an inter-layer connection conductor v4 interposed therebetween. The end portion at the inner side of the coil conductor layer 32*a* is connected to the end portion at the inner side of the coil conductor layer 32*b* with an inter-layer connection conductor v5 interposed therebetween. The end portion at the inner side of the coil conductor layer 34*a* is connected to the end portion at the inner side of the coil conductor layer 34*b* with an inter-layer connection conductor v6 interposed therebetween. The inter-layer connection conductors v4 to v6 are positioned in the area A, when viewed from the upper side. Accordingly, the inter-layer connection conductors v4 to v6 are also preferably positioned on the right side of the leftmost portion of the magnetic core 100, when viewed from the upper side, like the inter-layer connection conductors v1 to v3.

Also in the electronic component 10*b* having the above structure, the magnetic core 100 is capable of being arranged in the area A surrounded by the coil conductor layers 30*a*, 32*a*, 34*a*, 30*b*, 32*b*, 34*b*, 30*c*, 32*c*, and 34*c*, as in the electronic components 10 and 10*a*. In addition, also in the electronic component 10*b*, it is possible to make the area of the magnetic core 100 large, when viewed from the upper side, as in the electronic components 10 and 10*a*.

With the electronic component 10*b*, it is possible to reduce the difference in the differential impedance between the primary coil L1, the secondary coil L2, and the tertiary coil L3, as in the electronic component 10*a*. In addition, with the electronic component 10*b*, it is possible to bring the amounts of heat generation in the primary coil L1, the secondary coil L2, and the tertiary coil L3 close to each other, as in the electronic component 10*a*. Furthermore, with the electronic component 10*b*, the directionality of the electronic component 10*b* is lost, as in the electronic component 10*a*. Furthermore, with the Electronic component 10*b*, it is possible to bring the amount of heat generation in the coil conductor layer 30*c* close to the amount of heat generation in the parallel coil conductor layer 36, as in the electronic component 10*a*.

Although the electronic component 10*b* includes the three coil conductor layer groups Ga, Gb, and Gc, the electronic component 10*b* may include two coil conductor layer groups or four or more coil conductor layer groups. A case will now be described in which the electronic component 10*b* includes n-number (n is a natural number) coil conductor layer groups Ga, Gb, . . . .

When the electronic component 10*b* includes the n-number coil conductor layer groups Ga, Gb, . . . , the primary coil L1 includes n-number coil conductor layers 30*a*, 30*b*, . . . (an example of n-number primary coil conductor layers) and the parallel coil conductor layer 36. The secondary coil L2 includes n-number coil conductor layers 32*a*, 32*b*, . . . (an example of n-number secondary coil conductor layers). The tertiary coil L3 includes n-number coil conductor layers 34*a*, 34*b*, . . . (an example of n-number tertiary coil conductor layers). Arrangement of one coil conductor layer 30*a*, one coil conductor layer 32*a*, and one coil conductor layer 34*a* in this order from the lower side to the upper side forms one coil conductor layer group Ga. Arrangement of one coil conductor layer 30*b*, one coil conductor layer 32*b*, and one coil conductor layer 34*b* in this order from the lower side to the upper side forms one coil conductor layer group Gb. The coil conductor layer group Gc and the coil conductor layer groups subsequent to the coil conductor layer group Gc are formed in the same manner as in the coil conductor layers group Ga and Gb. The n-number coil conductor layer groups Ga, Gb, . . . are arranged in this order from the lower side to the upper side.

The parallel coil conductor layer 36 has substantially the same shape as that of a certain coil conductor layer (an example of a certain primary coil conductor layer), among the n-number coil conductor layers 30*a*, 30*b*, and is electrically connected in parallel to the certain coil conductor layer. In addition, the parallel coil conductor layer 36 is provided at the upper side of the uppermost coil conductor layer, among the n-number coil conductor layers 34*a*, 34*b*, . . . .

The coil conductor layers 30*a*, 30*b*, . . . are electrically connected in series to each other. The end portion at the outer side of the coil conductor layer 30*a* is the end portion t1 of the primary coil L1. The end portion at the inner side of the uppermost coil conductor layer (an example of the first coil conductor layer), among the coil conductor layers 30*a*, 30*b*, . . . , is the end portion t2 of the primary coil L1.

The coil conductor layers 32*a*, 32*b*, . . . are electrically connected in series to each other. The end portion at the outer side of the coil conductor layer 32*a* is the end portion t3 of the secondary coil L2. The end portion at the inner side of the uppermost coil conductor layer (an example of the second coil conductor layer), among the coil conductor layers 32*a*, 32*b*, . . . , is the end portion t4 of the secondary coil L2.

The coil conductor layers 34*a*, 34*b*, . . . are electrically connected in series to each other. The end portion at the outer side of the coil conductor layer 34*a* is the end portion t5 of the tertiary coil L3. The end portion at the inner side of the uppermost coil conductor layer (an example of the third coil conductor layer), among the coil conductor layers 34*a*, 34*b*, . . . , is the end portion t6 of the tertiary coil L3.

A case will now be described in which the maximum number of n is an odd number. The coil conductor layers 30*a*, 30*b*, . . . are electrically connected in series to each other. In the coil conductor layers 30*a*, 30*b*, . . . , the coil conductor layers (first type coil conductor layers) in which the coil conductors wind clockwise from the outer side to the inner side and the coil conductor layers (second type coil conductor layers) in which the coil conductors wind clockwise from the inner side to the outer side are alternately connected. The coil conductor layer closest to the outer electrode 14*a* in the primary coil L1 is the coil conductor layer 30*a*, which is the first type coil conductor layer. In contrast, the coil conductor layer closest to the outer electrode 14*d* in the primary coil L1 is the uppermost coil conductor layer (an example of the first coil conductor layer), among the coil conductor layers 30*a*, 30*b*, . . . . The uppermost coil conductor layer, among the coil conductor layers 30*a*, 30*b*, . . . , is the first type coil conductor layer. In order to arrange the first type coil conductor layer on both ends of the primary coil L1 in the above manner, it is sufficient for the odd-number coil conductor layers 30*a*, 30*b*, . . . to be electrically connected in series to each other. The same applies to the coil conductor layers 32*a*, 32*b*, . . . and the coil conductor layers 34*a*, 34*b*, . . . .

However, n may not be an odd number and may be an even number. Also when n is an even number, the coil conductor layers closest to the outer electrodes 14*d* to 14*f*, from the point of view of an electrical circuit, in the primary coil L1, the secondary coil L2, and the tertiary coil L3 are preferably the first type coil conductor layers.

(Third Modification)

Figure 9:
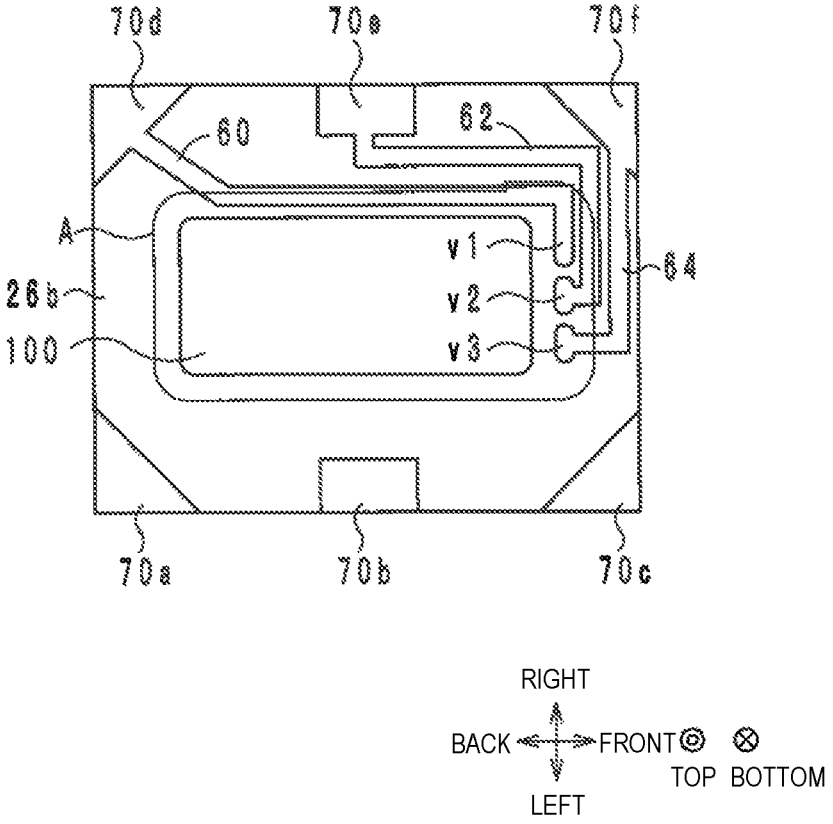
FIG. 9 is a plan view of an insulating layer, connection conductors, a magnetic core, and inter-layer connection conductors in an electronic component according to a third modification, when viewed from the upper side.

An electronic component 10*c* according to a third modification will now be described with reference to the drawings. FIG. 9 is a plan view of the insulating layer 26*b*, the connection conductors 70*a* to 70*f*, the magnetic core 100, and the inter-layer connection conductors v1 to v3 in the electronic component 10*c*, when viewed from the upper side.

The electronic component 10*c* differs from the electronic component 10 in the positions of the inter-layer connection conductors v1 to v3. The electronic component 10*c* will be described, focusing on the difference.

It is sufficient for the inter-layer connection conductors v1 to v3 to be positioned on the right side of the leftmost portion of the magnetic core 100, when viewed from the upper side. Accordingly, in the electronic component 10*c*, the inter-layer connection conductors v1 to v3 are positioned on the front side (an example of one side of the first perpendicular direction) of the magnetic core 100, when viewed from the upper side. More specifically, the inter-layer connection conductors v1 to v3 are arranged in line in this order from the right side to the left side along the front short side of the magnetic core 100.

With the electronic component 10*c* having the above structure, it is possible to make the area of the magnetic core 100 large, when viewed from the upper side. More specifically, when the inter-layer connection conductors v1 to v3 are arranged along the short sides of the magnetic core 100, when viewed from the upper side, it is necessary to make the long sides of the magnetic core 100 short in order to ensure the space for the inter-layer connection conductors v1 to v3. In this case, the amount of decrease in the area of the magnetic core 100 is substantially a product of the length of the short sides of the magnetic core 100 and the width in the front-and-back direction of the inter-layer connection conductors v1 to v3. Accordingly, the amount of decrease in the area of the magnetic core 100, which is caused by the provision of the inter-layer connection conductors v1 to v3, in the case in which the inter-layer connection conductors v1 to v3 are arranged along the short sides of the magnetic core 100 is smaller than that in the case in which the inter-layer connection conductors v1 to v3 are arranged along the long sides of the magnetic core 100.

The inter-layer connection conductors v1 to v3 may be positioned on the back side of the magnetic core 100, when viewed from the upper side.

(Fourth Modification)

Figure 10:
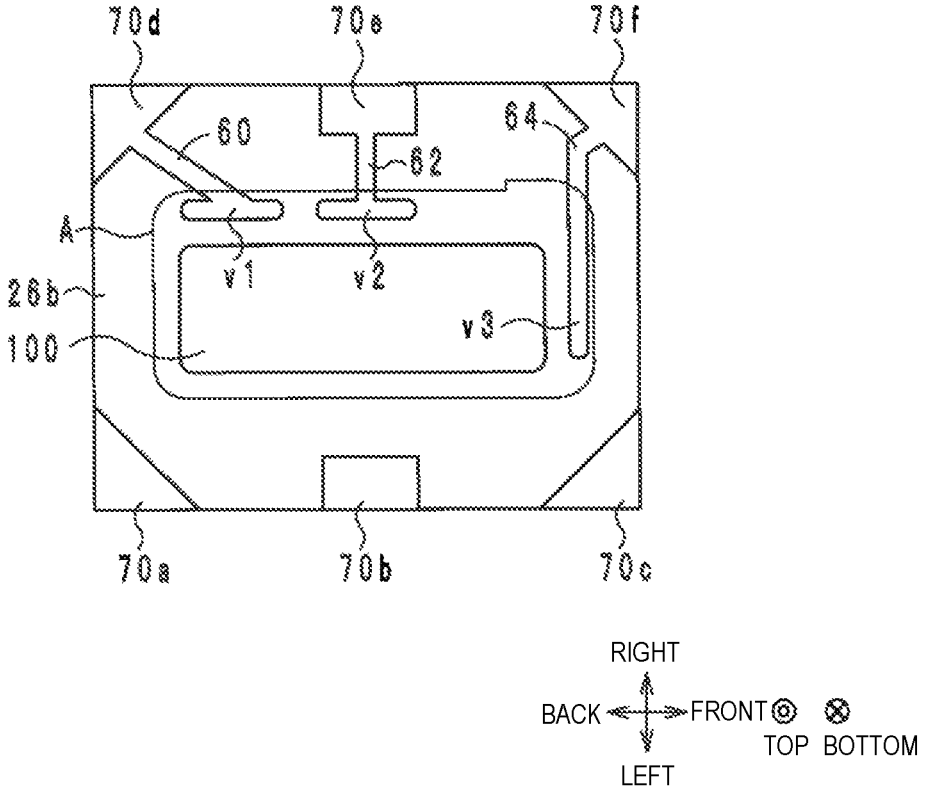
FIG. 10 is a plan view of the insulating layer, the connection conductors, the magnetic core, and the inter-layer connection conductors in an electronic component according to a fourth modification, when viewed from the upper side.

An electronic component 10*d* according to a fourth modification will now be described with reference to the drawings. FIG. 10 is a plan view of the insulating layer 26*b*, the connection conductors 70*a* to 70*f*, the magnetic core 100, and the inter-layer connection conductors v1 to v3 in the electronic component 10*d*, when viewed from the upper side.

The electronic component 10*d* differs from the electronic component 10 in the positions of the inter-layer connection conductors v1 to v3. The electronic component 10*d* will be described, focusing on the difference.

In the electronic component 10*d*, the inter-layer connection conductors v1 and v2 (an example of at least one of the first inter-layer connection conductor, the second inter-layer connection conductor, and the third inter-layer connection conductor) are positioned on the right side (an example of one side of the second perpendicular direction) of the magnetic core 100, when viewed from the upper side. More specifically, the inter-layer connection conductors v1 and v2 are arranged in line in this order from the back side to the front side along the right long side of the magnetic core 100. The inter-layer connection conductor v3 (an example of the remaining inter-layer connection conductors in the first inter-layer connection conductor, the second inter-layer connection conductor, and the third inter-layer connection conductor) is positioned on the front side (an example of one side of the first perpendicular direction) of the magnetic core 100, when viewed from the upper side.

The inter-layer connection conductor v1 may be positioned on the right side of the magnetic core 100, when viewed from the upper side, and the inter-layer connection conductors v2 and v3 may be positioned on the front side of the magnetic core 100, when viewed from the upper side. Alternatively, the inter-layer connection conductor v1 may be positioned on the back side of the magnetic core 100, when viewed from the upper side, and the inter-layer connection conductors v2 and v3 may be positioned on the right side of the magnetic core 100, when viewed from the upper side. Alternatively, the inter-layer connection conductors v1 and v2 may be positioned on the back side of the magnetic core 100, when viewed from the upper side, and the inter-layer connection conductor v3 may be positioned on the right side of the magnetic core 100, when viewed from the upper side.

(Fifth Modification)

Figure 11:
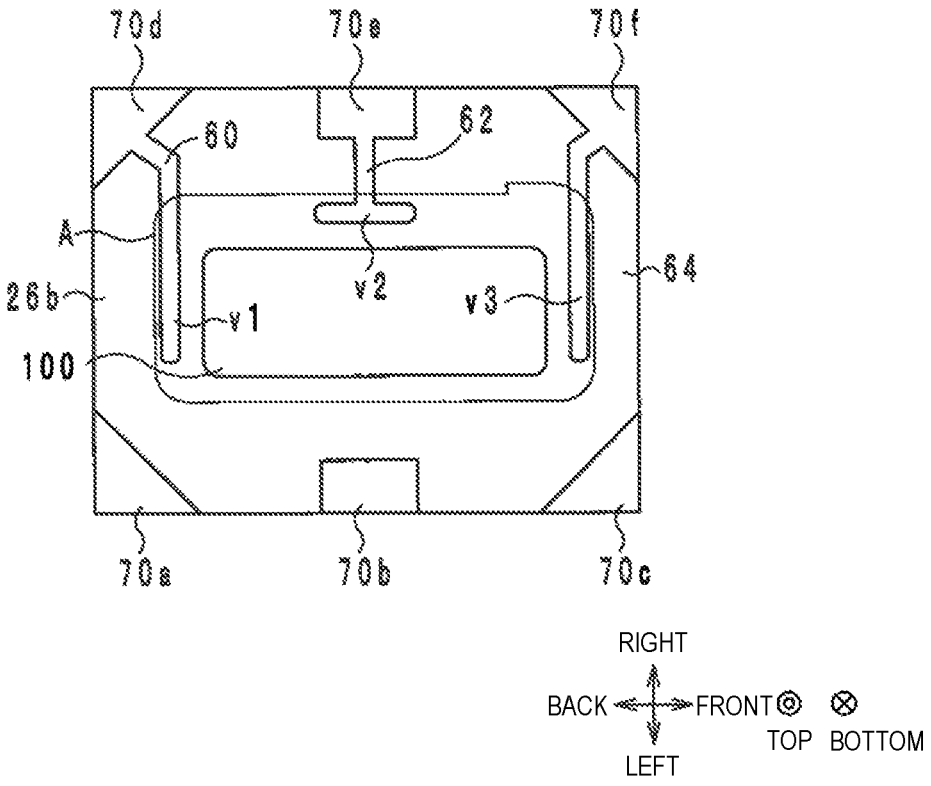
FIG. 11 is a plan view of the insulating layer, the connection conductors, the magnetic core, and the inter-layer connection conductors in an electronic component according to a fifth modification, when viewed from the upper side.
Figure 12:
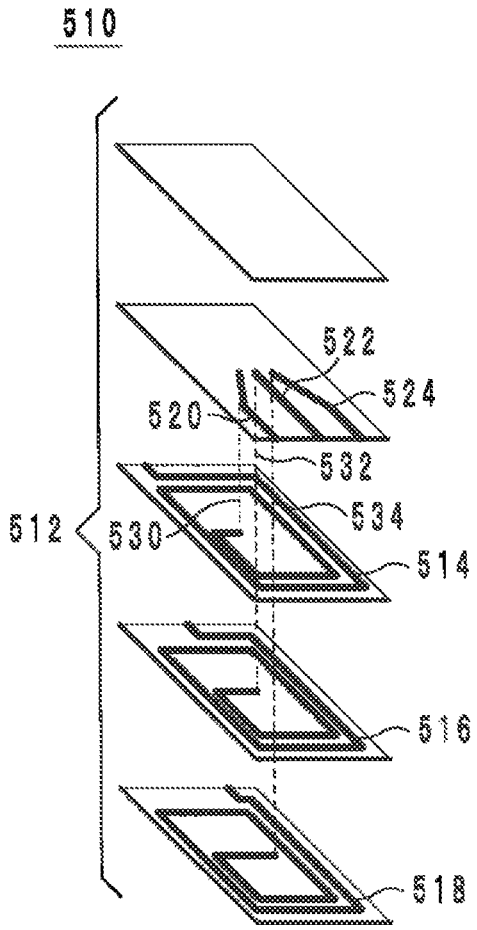
FIG. 12 is an exploded perspective view of a common mode choke coil described in Japanese Unexamined Patent Application Publication No. 2006-237080.

An electronic component 10*e* according to a fifth modification will now be described with reference to the drawings. FIG. 11 is a plan view of the insulating layer 26*b*, the connection conductors 70*a* to 70*f*, the magnetic core 100, and the inter-layer connection conductors v1 to v3 in the electronic component 10*e*, when viewed from the upper side.

The electronic component 10*e* differs from the electronic component 10 in the positions of the inter-layer connection conductors v1 to v3. The electronic component 10*e* will be described, focusing on the difference.

In the electronic component 10*e*, the inter-layer connection conductor v1 is positioned on the back side of the magnetic core 100, when viewed from the upper side. The inter-layer connection conductor v2 is positioned on the right side of the magnetic core 100, when viewed from the upper side. The inter-layer connection conductor v3 is positioned on the front side of the magnetic core 100, when viewed from the upper side.

Other Embodiments

The electronic components according to the present disclosure are not limited to the electronic component 10 and the electronic components 10*a* to 10*e* and may be modified within the scope and sprit of the present disclosure.

The configurations of the electronic component 10 and the electronic components 10*a* to 10*e* may be arbitrarily combined.

Although the electronic component 10 and the electronic components 10*a* to 10*e* are manufactured using the photolithographic method, the electronic component 10 and the electronic components 10*a* to 10*e* may be manufactured using, for example, a laminating method of laminating insulating layers, such as ceramic green sheets, on which the coil conductor layers are printed. In the method of manufacturing the electronic component 10 and the electronic components 10*a* to 10*e*, each conductor layer may be manufactured using, for example, a subtractive method, a (semi or full) additive method, an application method, or the vapor deposition method.

The magnetic substrates 20*a* and 20*b* may not be provided in the electronic component 10 and the electronic components 10*a* to 10*e*. In other words, the main body 12 may be composed of only the multilayer body 22.

In a case in which the electronic component 10*b* includes the n-number (n is a natural number) coil conductor layer groups Ga, Gb, . . . , the coil conductor layer groups Ga, Gb, . . . may be arranged in this order from the upper side to the lower side. In the coil conductor layer group Ga, the coil conductor layers 30*a*, 32*a*, and 34*a* may be arranged in this order from the upper side to the lower side. The same applies to the coil conductor layer group Gb and the subsequent coil conductor layer groups.

In the electronic component 10 and the electronic components 10*a* to 10*e*, the outer electrodes 14*a* to 14*c* may be provided on the right side of the main body 12 and the outer electrodes 14*d* to 14*f* may be provided on the left side of the main body 12. In this case, the extended conductor layers 60, 62, and 64 may be directly connected to the outer electrodes 14*d* to 14*f*, respectively.

The main body 12 may not necessarily form a substantially rectangular parallelepiped shape. It is sufficient for the main body 12 to have at least the right face.

In the electronic component 10, for example, each of the primary coil L1, the secondary coil L2, and the tertiary coil L3 may include two coil conductor layers. In this case, it is sufficient for the primary coil L1 to include the coil conductor layer in which the coil conductor winds clockwise from the outer side to the inner side and the coil conductor layer in which the coil conductor winds clockwise from the inner side to the outer side. The end portions at the inner side of these coil conductor layers are connected to each other with the inter-layer connection conductor v1 interposed therebetween. The secondary coil L2 and the tertiary coil L3 have the same structure as that of the primary coil L1.

As described above, the present disclosure is useful for an electronic component. In particular, the present disclosure is useful for a three-line differential transmission circuit common mode filter including the primary coil, the secondary coil, and the tertiary coil.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An electronic component comprising:

a main body including a multilayer body in which a plurality of insulating layers including a plurality of first insulating layers are laminated in a laminating direction;

a primary coil including a spiral first coil conductor layer, a secondary coil including a spiral second coil conductor layer, and a tertiary coil including a spiral third coil conductor layer, the first coil conductor layer, the second coil conductor layer, and the third coil conductor layer being provided at different positions in the laminating direction in the multilayer body;

a first outer electrode, a second outer electrode, and a third outer electrode that are provided on the main body and that are arranged in this order from a first side to a second side of a first perpendicular direction perpendicular to the laminating direction;

a fourth outer electrode, a fifth outer electrode, and a sixth outer electrode that are provided on the main body, that are arranged in this order from the first side to the second side of the first perpendicular direction, and that are positioned at a first side of a second perpendicular direction perpendicular to the laminating direction and the first perpendicular direction, compared with the first outer electrode, the second outer electrode, and the third outer electrode;

a magnetic core that passes through the plurality of first insulating layers in the laminating direction so as to pass through the first coil conductor layer, the second coil conductor layer, and the third coil conductor layer in the laminating direction at a center of a certain area surrounded by the first coil conductor layer, the second coil conductor layer, and the third coil conductor layer, when viewed from the laminating direction, the magnetic core having a permeability higher than that of the plurality of insulating layers; and a first inter-layer connection conductor, a second inter-layer connection conductor, and a third inter-layer connection conductor that pass through at least one of the plurality of first insulating layers in the laminating direction in the certain area, when viewed from the laminating direction, wherein the primary coil is electrically connected between the first outer electrode and the fourth outer electrode, wherein the secondary coil is electrically connected between the second outer electrode and the fifth outer electrode, wherein the tertiary coil is electrically connected between the third outer electrode and the sixth outer electrode, wherein the first inter-layer connection conductor, the second inter-layer connection conductor, and the third inter-layer connection conductor are electrically connected to an end portion at an inner side of the first coil conductor layer, an end portion at an inner side of the second coil conductor layer, and an end portion at an inner side of the third coil conductor layer, respectively, and wherein the first inter-layer connection conductor, the second inter-layer connection conductor, and the third inter-layer connection conductor are not positioned at the first side of the second perpendicular direction, compared with the magnetic core, when viewed from the laminating direction.

2. The electronic component according to claim 1, wherein the first inter-layer connection conductor, the second inter-layer connection conductor, and the third inter-layer connection conductor are positioned at a second side of the second perpendicular direction, compared with a portion closest to the second side of the second perpendicular direction in the magnetic core, when viewed from the laminating direction.

3. The electronic component according to claim 1, wherein a length of the certain area in the second perpendicular direction is shorter than a length of the certain area in the first perpendicular direction.

4. The electronic component according to claim 1, wherein at least one of the first inter-layer connection conductor, the second inter-layer connection conductor, and the third inter-layer connection conductor is positioned at a second side of the second perpendicular direction, compared with the magnetic core, when viewed from the laminating direction, and wherein the remaining inter-layer connection conductors, among the first inter-layer connection conductor, the second inter-layer connection conductor, and the third inter-layer connection conductor, are positioned at the first side or the second side of the first perpendicular direction, compared with the magnetic core, when viewed from the laminating direction.

5. The electronic component according to claim 1, wherein end portions at an outer side of the first coil conductor layer, the second coil conductor layer, and the third coil conductor layer are electrically connected to the fourth outer electrode, the fifth outer electrode, and the sixth outer electrode, respectively, and are positioned at the first side of the second perpendicular direction, compared with a portion closest to the first side of the second perpendicular direction in the magnetic core, when viewed from the laminating direction.

6. The electronic component according to claim 1, wherein the main body further include magnetic substrates laminated at a first side or a second side of the laminating direction of the multilayer body.

7. The electronic component according to claim 1, wherein the primary coil includes spiral n-number, where n is a natural number, primary coil conductor layers that are electrically connected in series to each other, wherein the secondary coil includes spiral n-number, where n is a natural number, secondary coil conductor layers that are electrically connected in series to each other, wherein the tertiary coil includes spiral n-number, where n is a natural number, tertiary coil conductor layers that are electrically connected in series to each other, wherein the n-number primary coil conductor layers include the first coil conductor layer, wherein the n-number secondary coil conductor layers include the second coil conductor layer, wherein the n-number tertiary coil conductor layers include the third coil conductor layer, wherein arrangement of one primary coil conductor layer, one secondary coil conductor layer, and one tertiary coil conductor layer in this order from a first side to a second side of the laminating direction composes one coil conductor layer group, and wherein the n-number coil conductor layer groups are arranged from the first side to the second side of the laminating direction.

8. The electronic component according to claim 7, wherein a maximum number of n is an odd number.

9. The electronic component according to claim 7, wherein the primary coil further includes a parallel primary coil conductor layer, and wherein the parallel primary coil conductor layer has substantially the same shape as that of a certain primary coil conductor layer, among the n-number primary coil conductor layers, is electrically connected in parallel to the certain primary coil conductor layer, and is provided on the second side of the laminating direction of the tertiary coil conductor layer, which is provided closest to the second side of the laminating direction.

10. The electronic component according to claim 1, further comprising:

a first extended portion that connects an end portion at a first side of the primary coil to the first outer electrode, a second extended portion that connects an end portion at a first side of the secondary coil to the second outer electrode, and a third extended portion that connects an end portion at a first side of the tertiary coil to the third outer electrode, wherein the first extended portion, the second extended portion, and the third extended portion include the first inter-layer connection conductor, the second inter-layer connection conductor, and the third inter-layer connection conductor, respectively, and wherein the end portion at the inner side of the first coil conductor layer is the end portion at the first side of the primary coil, the end portion at the inner side of the second coil conductor layer is the end portion at the first side of the secondary coil, and the end portion at the inner side of the third coil conductor layer is the end portion at the first side of the tertiary coil.

11. The electronic component according to claim 10, wherein the first extended portion, the second extended portion, and the third extended portion further include a first extended conductor layer, a second extended conductor layer, and a third extended conductor layer, respectively, which are provided at different positions compared with the first coil conductor layer, the second coil conductor layer, and the third coil conductor layer in the laminating direction in the multilayer body, wherein the first inter-layer connection conductor, the second inter-layer connection conductor, and the third inter-layer connection conductor are arranged in this order from the first side to the second side of the first perpendicular direction, wherein the end portion at a first side of the first extended conductor layer is connected to the first inter-layer connection conductor, wherein the end portion at a first side of the second extended conductor layer is connected to the second inter-layer connection conductor, and wherein the end portion at a first side of the third extended conductor layer is connected to the third inter-layer connection conductor.

12. The electronic component according to claim 11, wherein the end portions at the inner side of the first coil conductor layer, the second coil conductor layer, and the third coil conductor layer are arranged in this order from the first side to the second side of the first perpendicular direction.

13. The electronic component according to claim 11, wherein the first outer electrode is provided on a face positioned at a first side or a second side of the laminating direction in the main body, and wherein the end portion at a second side of the first extended conductor layer overlaps with the first outer electrode, when viewed from the laminating direction.

* * * * *